US012660907B2

(12) United States Patent
Dalton, VI

(10) Patent No.: US 12,660,907 B2
(45) Date of Patent: Jun. 23, 2026

(54) MULTIFUNCTIONAL MEDICAL SUPPLY RECEPTACLE AND METHODS OF USE THEREOF

(71) Applicant: Pulse Pack LLC, Stockton, UT (US)

(72) Inventor: Edward Arthur Dalton, VI, Stockton, UT (US)

(73) Assignee: Pulse Pack LLC, Stockton, UT (US)

( * ) Notice: Subject to any disclaimer, the term of this patent is extended or adjusted under 35 U.S.C. 154(b) by 72 days.

(21) Appl. No.: 18/633,988

(22) Filed: Apr. 12, 2024

(65) Prior Publication Data

US 2024/0341457 A1 Oct. 17, 2024

Related U.S. Application Data

(60) Provisional application No. 63/495,825, filed on Apr. 13, 2023.

(51) Int. Cl.
*A45F 4/02* (2006.01)

(52) U.S. Cl.
CPC ..... *A45F 4/02* (2013.01)

(58) Field of Classification Search
CPC .... A45C 2007/0004; A45C 2007/0013; A45C 2007/0009; A45C 7/009
USPC ..... 224/575, 577
See application file for complete search history.

(56) References Cited

U.S. PATENT DOCUMENTS 4,157,134 A * 6/1979 Stoll ..... A45C 9/00 441/88
4,753,329 A * 6/1988 Choy ..... A45C 7/0095 190/111
4,783,886 A 11/1988 Lou
4,970,821 A * 11/1990 Young ..... A01K 97/06 206/315.11
5,101,815 A 4/1992 Lnagdon-Orr et al.
6,193,034 B1 * 2/2001 Fournier ..... A45C 7/0095 206/289
6,296,094 B1 * 10/2001 Knecht ..... A45C 7/0095 206/281
6,948,203 B2 9/2005 Chiang-Han
7,171,707 B2 2/2007 Lisa
7,455,178 B2 * 11/2008 Miller, Jr. ..... A45C 13/02 190/125

(Continued)

FOREIGN PATENT DOCUMENTS

KR 200453379 Y1 * 4/2011 ..... A45F 4/02
KR 101455758 B1 * 11/2014 ..... A45F 4/02

OTHER PUBLICATIONS

English translation of KR200453379 (Year: 2011).*
English translation of KR101455758 (Year: 2014).*

*Primary Examiner* — Scott T Mcnurlen

(57) ABSTRACT

A multifunctional medical supply receptacle (MMSR) includes an elongated, substantially planar structure. The elongated, substantially planar structure includes a first surface and a second surface, the first surface being opposite the second surface, and at least one substantially planar segment. The at least one substantially planar segment forms the substantially planar structure. The MMSR also includes at least one receptacle pod forming an interior volume wherein supplies are stored. The at least one receptacle pod includes at least one closable opening, and the at least one receptacle pod is configured to be attached to the first surface of the elongated, substantially planar structure.

20 Claims, 15 Drawing Sheets

(56) References Cited

U.S. PATENT DOCUMENTS

| | | | | |
|---|---|---|---|---|
| 10,327,522 | B2 | 6/2019 | Karina | |
| 10,349,713 | B2 * | 7/2019 | Millen | A45C 7/00 |
| 10,455,921 | B2 * | 10/2019 | Kesler | A45F 3/02 |
| 2006/0207697 | A1 * | 9/2006 | Greiner | A45C 7/0095 150/113 |
| 2021/0361045 | A1 * | 11/2021 | Wood | A45C 13/1046 |
| 2024/0164560 | A1 * | 5/2024 | Schroeder | A47G 27/0206 |

* cited by examiner

MULTIFUNCTIONAL MEDICAL SUPPLY RECEPTACLE AND METHODS OF USE THEREOF

PRIORITY CLAIM

This Application claims priority to Provisional Application No. 63/495,825 filed on Apr. 13, 2023.

COPYRIGHT NOTICE

A portion of the ensuing patent specification and appended drawing figures contains materials subject to copyright protection. The owner, Edward Dalton, has no objection to the facsimile reproduction of any one of the patent documents or the patent disclosures, as it appears in the United States Patent and Trademark Office files, records, or as is required by law, but otherwise reserves all copyright rights and protections whatsoever.

BACKGROUND

Medical supply receptacles, such as first-aid kits and medical bags, are generally utilized in the prehospital setting to facilitate the convenient availability and accessibility of emergency medical supplies wherever the receptacle is stationed. Medical supply receptacles are commonly stocked with a variety of independent, standalone supplies, such as splints, pelvic binders, cervical collars, bandages, gauze, tourniquets, patient litters or stretchers, emergency lighting devices, and/or other components, as dictated by various factors such as the end user(s) unique preparedness needs, level of medical training and experience, personal preference, and other environmental factors, etc.

Current first-aid delivery systems and solutions vary in design based on the intended use contemplated and, therefore, are inconveniently limited in modularity and adaptability, unable to meet the diverse medical and emergency preparedness needs of different individuals, groups, organizations, etc., using one design platform.

Medical supply receptacles, and the assortment of supplies contained therein, are widely available on the market today—whether sold separately or together. When offered together, supplies are generally comprised of standalone components within the receptacle, to be removed from and utilized independently of the receptacle containing them, which is merely configured and utilized as a storage means until the contained supplies are needed. Therefore, medical supply receptacles do not, themselves, offer any clinical benefits or advantages beyond those of the individual supplies contained therein.

Medical and/or emergency devices, such as orthopedic immobilization devices (e.g., extremity splints, pelvic binders, cervical collars, thoracic splints, etc.), bleeding control devices (e.g., bandages, extremity tourniquets, junctional tourniquets, etc.), improvised emergency floatation devices, patient transport litters or stretchers, and emergency lighting devices (e.g., illumination devices, glow sticks, chem lights, etc.) all lack synergy and are not independently capable of effectively providing the collective utility or clinical benefits of each other, despite their frequent association with each other as first-aid and emergency supplies.

Orthopedic immobilization devices are relatively large medical devices commonly stocked together in medical supply receptacles, consuming a large amount of valuable storage space within medical supply receptacles.

Bleeding control devices are also relatively large medical devices that consume a large amount of valuable storage space when stocked within medical supply receptacles.

Personal floatation devices of any classification are also voluminous, as greater volume positively correlates with more effective buoyancy.

Patient transport devices are also considerably large space-consuming medical equipment, generally too large to stock within medical supply receptacles, or consuming a significant amount of valuable storage space if so.

Emergency lighting devices also consume usable space within medical supply receptacles and are difficult to locate within the receptacle during low-light or no-light situations when emergency lighting is needed.

Medical supply receptacles are generally cavernous with an overwhelming number of pockets or compartments making it difficult to quickly locate supplies within, especially under the stress of an emergency when time is of the essence.

The limited storage capacity of medical supply receptacles is prohibitive to the size and amount of supplies containable therein, thereby inconveniently compromising functionality for size.

These conventional systems, solutions, devices, assemblies, configurations, and methods/processes of use thereof are complete and fully functional in themselves, and hence teach by implication that they cannot be integrated, and are mutually exclusive in purpose and function, or would at least require unapparent redesign and tooling to successfully integrate any of the references and their respective advantages.

Consequently, there remain large, unfilled, and long-felt needs across multiple crowded industries and art classifications necessitating unordinary inventions/innovations to aspects of existing state-of-the-art technologies that are unsuccessful, despite efforts over many years to provide more effective, efficient first-aid delivery systems and solutions.

The systems, solutions, devices, assemblies, configurations, and methods/processes of use of the present disclosure solve these and other limitations and shortcomings of existing conventional systems and solutions.

BRIEF DESCRIPTION OF THE DRAWINGS

A greater appreciation of the nonobvious innovations and the resultant new, unexpected advantages provided by various embodiments of the present disclosure, titled Multifunctional Medical Supply Receptacle (MMSR) and Methods of Use Thereof, is realized by reference to the following drawing figures, their descriptions, and respective reference numerals. Similar or interchangeable elements may have the same reference numerals or be cross-referenced in this specification and the appended drawing figures. The appended drawing figures are provided by way of illustration for exemplification only and are not to be interpreted as a definition or limit of other embodiments described herein or the scope of the claims.

DETAILED DESCRIPTION

The present disclosure is directed to a Multifunctional Medical Supply Receptacle (MMSR) and Methods of Use Thereof. The MMSR apparatus generally relates to at least the industries and art classifications of soft goods, healthcare/medicine, floatation devices, and emergency lighting. More particularly, this specification is directed to at least the technical fields of bag receptacles, medical and/or emergency devices, improvised emergency floatation devices, and illumination devices—all of which are classified within the statutory class of articles of manufacture.

Specifically, the present disclosure demonstrates at least the novel, nonobvious construction of a storage apparatus capable of being operable as one or more medical and/or emergency devices to achieve clinical benefits, providing buoyancy, emergency lighting, and additional advantages. Also provided are examples of methods and processes for operating said apparatus as a versatile first-aid delivery system in a wide variety of practical medical and emergency scenarios, thereby achieving more effective and efficient medical and emergency management solutions.

Figure 1:
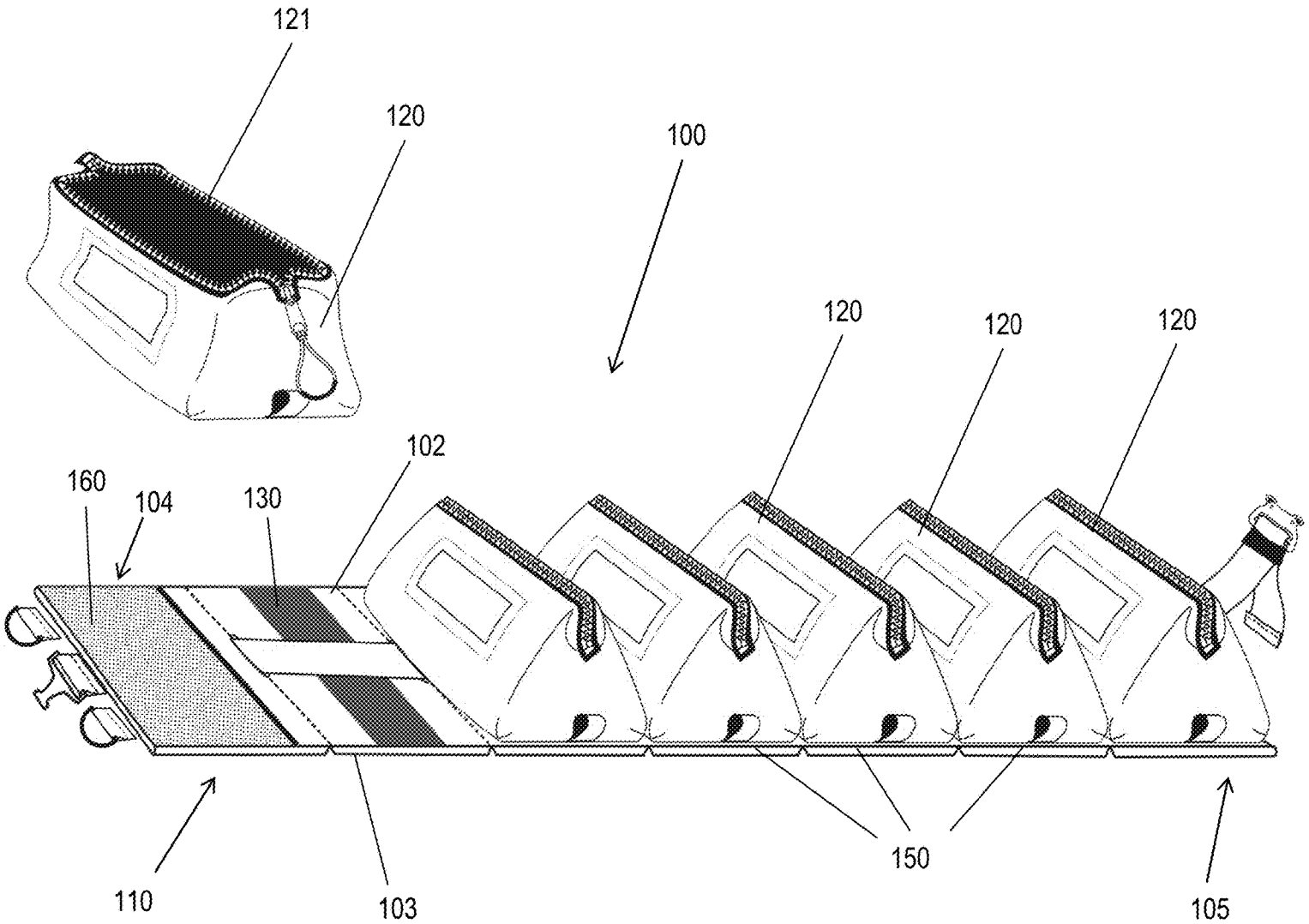
FIG. 1 illustrates an isometric view of a MMSR in an opened configuration, according to some embodiments.

FIG. 1 is an isometric view of a MMSR 100 in accordance with some embodiments. FIG. 1 shows the MMSR 100 in an open configuration. As shown in FIG. 1, an MMSR 100 can include an elongated, substantially planar structure 110 that includes a semirigid material. For example, the semirigid material may include thermoset polymers, thermoplastic polymers, polycarbonate, acrylics, or any other semirigid material. As shown in FIG. 1, an MMSR 100 can have a first surface 102 and a second surface 103 and opposing longitudinal and lateral edges.

In some embodiments, the substantially planar structure 110 can be flexible at least longitudinally and laterally. For example, the elongated, substantially planar structure 110 can become longitudinally rigid/static responsive to wherever a lateral bend is applied across at least a portion of the total length of the planar structure 110.

According to some embodiments, the semirigid material of the substantially planar structure 110 is selectably laterally bendable across its total length, whereby the substantially planar structure can become longitudinally rigid and/or static across its entire total length. In one embodiment, the semirigid material of the substantially planar structure 110 is selectably laterally bendable across at least a portion of its total length, whereby the substantially planar structure 110 can become longitudinally rigid and/or static only across the laterally-bent length, or lengths.

FIG. 1 also shows at least one receptacle pod(s) 120. The at least one receptacle pod(s) 120 can form an interior volume and at least one closable opening 121 wherethrough supplies can be placeable and retrievable from the interior volume. In some embodiments, the at least one receptacle pod(s) 120 may be attachable to the first surface 102 of the elongated, substantially planar structure 110. The at least one receptacle(s) can also be attachable to the second surface 103.

In some embodiments, the at least one receptacle pod(s) 120 may include, for example, bleeding control supplies, which may be separated from the MMSR 100 and independently distributed for the treatment of multiple patients in different locations, for example, in a mass casualty incident (MCI). In other embodiments, the receptacle pod(s) 120 may include supplies for other injury types, or any combinations thereof, whereby a MMSR 100 may be highly customizable to meet the diverse medical and emergency preparedness needs of different users.

In some embodiments, the receptacle pod 120 can be attached to the MMSR 100 by an attachment component 130. A receptacle pod 120 may be removably attached to the substantially planar structure 110. The receptacle pod 120 can be removably attached to the first surface 102 and/or the second surface 103 by a hook and loop fastener, a zipper, or any other component that enables the receptacle pod 120 to be removably attached to the first surface 102 and/or the second surface 103.

According to some embodiments, the at least one receptacle pod(s) 120 can be permanently attached to the first surface 102 and/or the second surface 103 by adhesion, sewing, fusion, or any other component that enable the at least one receptacle pod(s) 120 to be permanently attached to the first surface 102 and/or the second surface 103.

FIG. 1 additionally shows that the semirigid material of the elongated, substantially planar structure 110 and at least one receptacle pod(s) 120 can include one or more semirigid substrates 150. The one or more semirigid substrates 150 can be encased or layered in a textile material such as fabric that can surround the one or more semirigid substrates 150. According to an embodiment, the semirigid material of the at least one receptacle pod(s) 120, alternatively, includes primarily a textile material without a semirigid substrate material encased.

According to FIG. 1, the elongated, substantially planar structure 110 can include one or more storage pockets 160. The one or more storage pockets 160 may be located anywhere on the substantially planar structure 110. For example, as shown in FIG. 1, there can be one storage pocket located on the first surface 102 at a first end 104 of the substantially planar structure 110. There can be one storage pocket located on the second end 105 or the second surface 103. In short, there can be any number of storage pockets 160 located anywhere on the substantially planar structure 110. The one or more storage pockets 160 can be made out of any suitable material, for example, a mesh material. The first end 104 can be a proximal end. Thus one or more storage pockets 160 may be disposed at a proximal end of the elongated, substantially planar structure 110. Additionally, in some embodiments, one or more storage pockets 160 may be disposed at a second end 105. The second end 105 can be a distal end.

Figure 2:
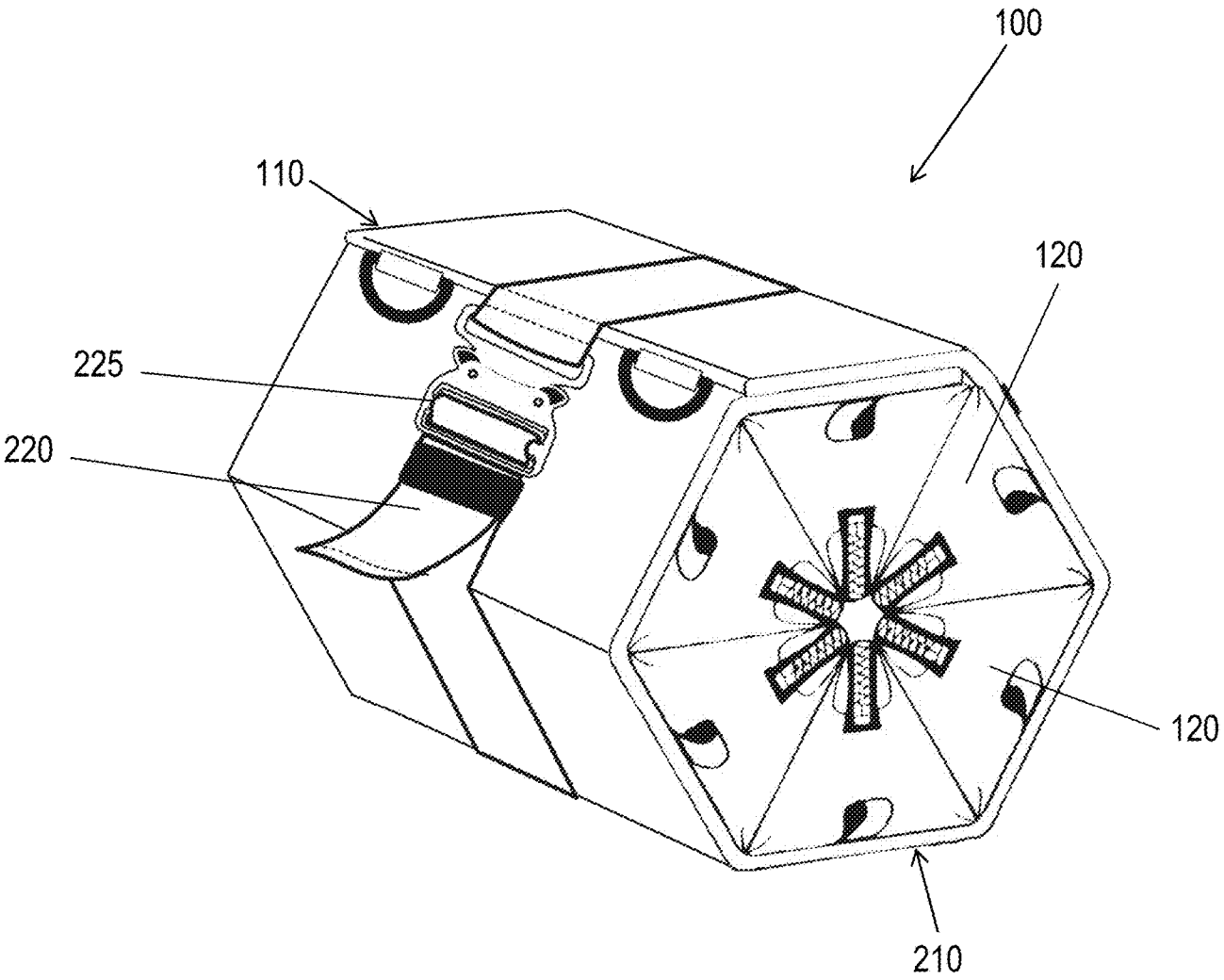
FIG. 2 illustrates an isometric view of a MMSR in an assembled/closed configuration, according to some embodiments.

FIG. 2 is an isometric view of an MMSR 100 in accordance with some embodiments. FIG. 2 shows the MMSR 100 in a closed configuration. FIG. 2 shows that the elongated, substantially planar structure 110 can selectably form a hollow extruded prismatic shape 210 responsive to a longitudinal-bend. The longitudinal-bend can include either a substantially continuous radius and/or a series of angles and may be applicable peripherally around the at least one receptacle pod(s) 120. In some embodiments, the at least one receptacle pod(s) 120 can at least partially fill a hollow void created within the hollow extruded prismatic shape 210.

In some embodiments, the elongated, substantially planar structure 110 selectably forms a hollow, extruded, and prismatic shape 210 such that the first surface 102 of the elongated, substantially planar structure 110 is on an interior of the hollow, extruded, and prismatic shape, and the second surface 103 of the elongated, substantially planar structure is on an exterior of the hollow, extruded, and prismatic shape.

FIG. 2 also shows that the elongated, substantially planar structure 110 can form a hollow extruded cylinder, oblong, or oval cylindrical shape 210 responsive to a longitudinal bend being applied at a substantially continuous radius. In some embodiments, at least one receptacle pod(s) 120 may at least partially fill the hollow extruded shape 210. The number and shape of the at least one receptacle pod(s) 120 can correspond to the number of sides of the shape 210. For example, as shown in FIG. 2, there can be the same number of receptacle pods 120 as the number of sides of the hollow, extruded, and prismatic shape 210. As an illustrative example, if the shape 210 were a hollow, extruded, and prismatic hexagonal shape 210, such as in FIG. 2, then there can be 6 receptacle pods 120. Embodiments can thus enable an efficient use of space inside the hollow, extruded, and prismatic shape 210.

In some embodiments, there can be more receptacle pods 120 as the number of sides of the hollow, extruded, and prismatic shape 210. For example, if the shape 210 were a hollow, extruded, and prismatic hexagonal shape 210, such as in FIG. 2, then there can be more than 6 receptacle pods 120. Embodiments can thus enable a greater variety of medical devices in the MMSR 100.

FIG. 2 also shows that an assembled MMSR 100 can form an extruded hexagonal prismatic shape 210. In other embodiments, the assembled MMSR 100 can form an extruded cylindrical shape 210. In other embodiments, the assembled MMSR 100 may form a circular, ovular, oblong, polygonal, triangular, rectangular, square, quadrilateral, pentagonal, hexagonal, heptagonal, octagonal, trapezoidal, and any other regular or irregular extruded prismatic or cylindrical shape. The MMSR 100 can have a shape selected from a group consisting of the above-discussed shapes.

According to an embodiment, the total number of the at least one receptacle pod(s) 120 contained in an MMSR 100 can correspond to the number of substantially planar sides created by the extruded polygonal prismatic shape 210.

According to an embodiment, a longitudinal-bend may be applicable to the elongated, substantially planar structure 110. The substantially planar structure 110 can be selectably circumferentially closed proximate opposing lateral ends or edges by a tightening component 220. The tightening component 220 can be an adjustable-length tension strap, elastic band, bungee cord, rescue-grade nylon webbing, a tourniquet, or any other component capable of tightening. The tightening component 220 can be either fixed to or removable from the elongated, substantially planar structure 110.

FIG. 2 also shows the tightening component 220 can include a connection component 225. The connection component 225 can include a latch, clasp, buckle mechanism, or any other component capable of connecting. According to an embodiment, the MMSR 100 may be fastenably closable by wrapping the tightening component 220 peripherally around and parallel longitudinally to the elongated, substantially planar structure 110, then fastening with the connection component 225 proximate the opposing lateral ends or edges to apply circumferential pressure, thereby securing the hollow extruded shape of a MMSR in the closed configuration.

Figure 3:
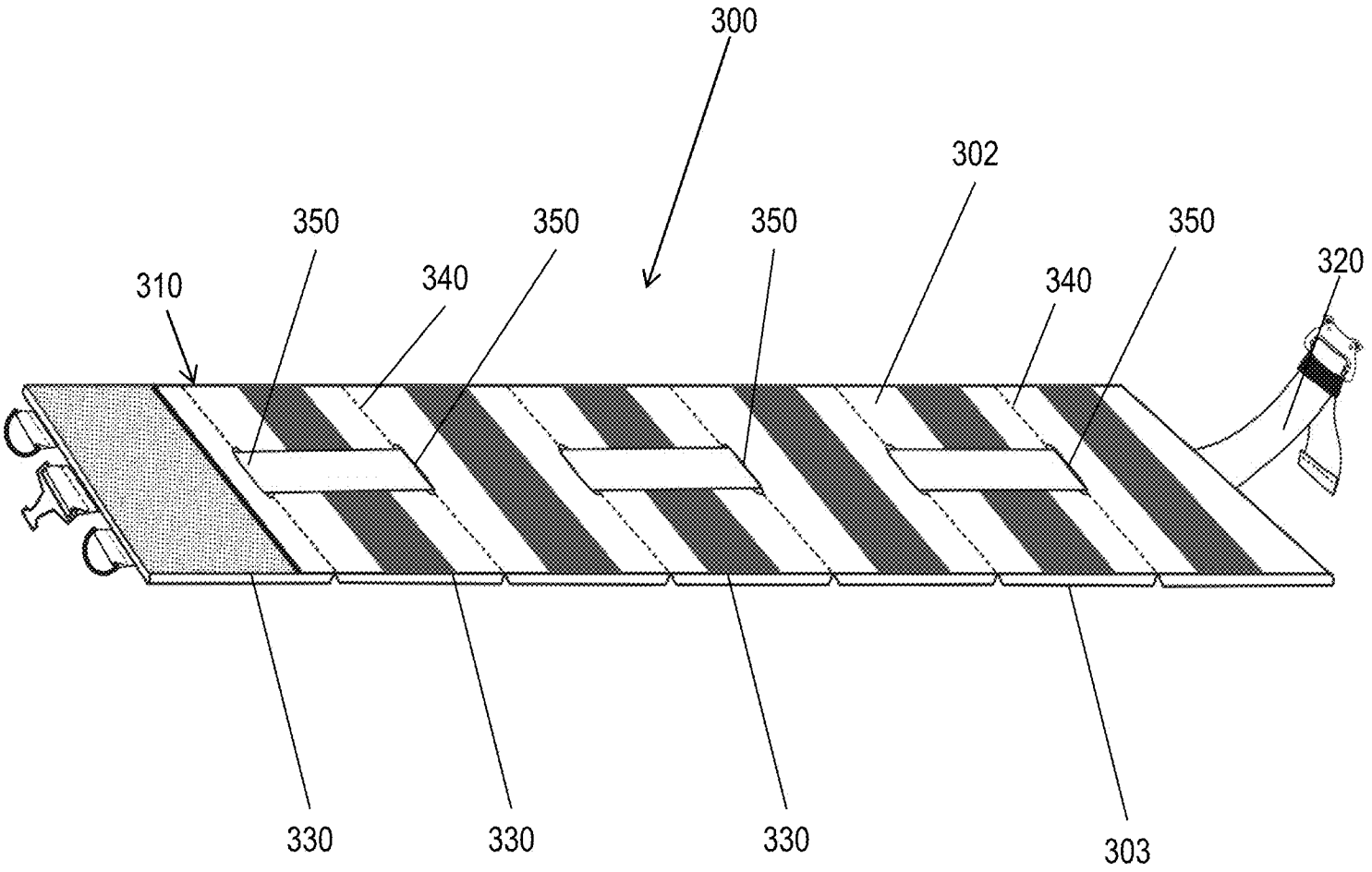
FIG. 3 illustrates an isometric view of a MMSR in an opened configuration, wherein the receptacle pod(s) are detached, according to some embodiments.

FIG. 3 is an isometric view of a MMSR 300 in the opened configuration, according to some embodiments. FIG. 3 shows a MMSR 300 without any receptacle pods 120 attached thereof. According to some embodiments, the opened MMSR 300 can include at least one elongated, substantially planar structure 310 that includes a semirigid material having a first surface 302 and a second surface 303 and opposing longitudinal and lateral edges. The substantially planar structure 310 can be flexible at least longitudinally and laterally. The substantially planar structure 310 can also be longitudinally rigid and/or static responsive to wherever a lateral-bend is applied across at least a portion of its total length.

FIG. 3 also shows an embodiment in which the elongated, substantially planar structure 310 can be divided into one or more similar-sized adjacent substantially planar segment(s) 330 arranged longitudinally. The planar segment(s) 330 can each be connectable to the other by one or more hinged linker(s) 340. The one or more hinged linker(s) 340 may include creases or joints in the semirigid material and/or seams sewn in the textile material between planar segment (s) 330, or any other suitable linker configured to hinge.

In other embodiments, the elongated, substantially planar structure 310 can form a hollow extruded polygonal prismatic shape 210 responsive to a series of longitudinal-bends such as folds being applied to hinged linker(s) 340 at a series of angles. The substantially planar structure 310 can be similar to the substantially planar structure 110 of FIG. 1 and can form any of the shapes previously discussed in regards to the substantially planar structure 110 of FIG. 1 and FIG. 2.

According to an embodiment, the number of receptacle pods 120 can correspond to the number of planar segment(s) 330. For example, there can be one fewer receptacle pods 120 than there are planar segment(s) 330. This may be due to the stacking of one planar segment(s) 330 on top of another planar segment(s) 330 when the MMSR 300 is in a closed configuration. Thus, for an illustrative example, if there were 7 planar segment(s) 330 as shown in FIG. 3, then there could be any integer value from 0 to 6, inclusive, of receptacle pods 120. Embodiments can thus enable an efficient use of space inside the hollow, extruded, and prismatic shape 210.

According to some embodiments, there can be any number of receptacle pods 120. For example, there can be more receptacle pods 120 than there are planar segment(s) 330. There can be more than one receptacle pod attached to a planar segment 330. Embodiments can thus enable a higher degree of variety of medical supplies in the MMSR 300 because there can be any number of receptacle pods 120 that store and carry the medical supplies, including a number that is more than the planar segments 330.

FIG. 3 also shows a tightening component 320 which can be similar to the tightening component 220 of FIG. 2. The tightening component 320 can be permanently affixed to the elongated, substantially planar structure 310. In some embodiments, the tightening component 320 can be removably attached to the elongated, substantially planar structure 310. According to one embodiment, one or more retentioning components, such as aperture(s) or loop(s) 350 can be incorporated on the elongated, substantially planar structure 310 at or near the one or more hinged linker(s) 340 wherethrough the tightening component 320 is threadable or removable.

Figure 4:
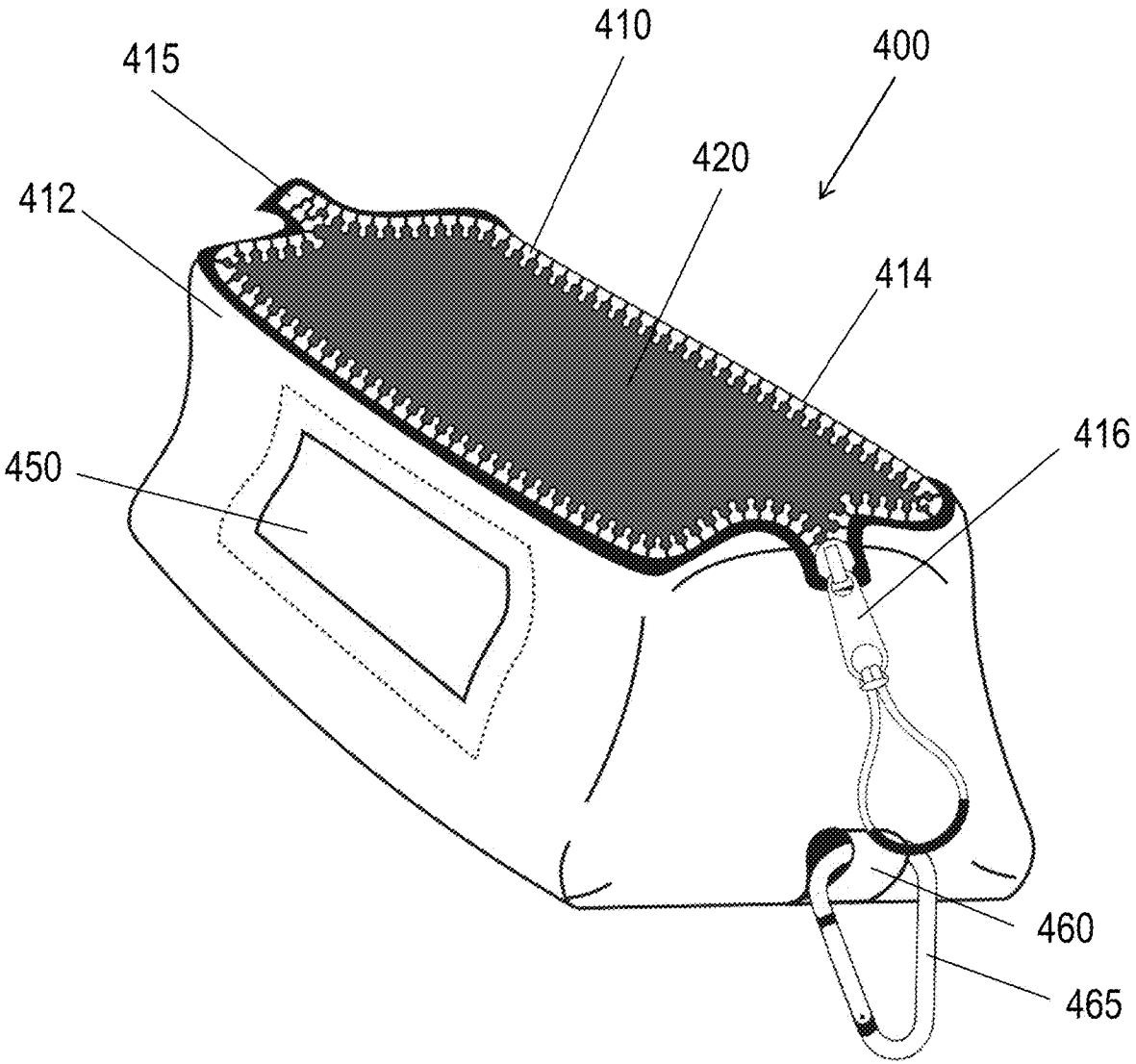
FIG. 4 illustrates an isometric view of an opened receptacle pod, according to some embodiments.

FIG. 4 is an isometric view of an opened receptacle pod 400, according to some embodiments. The receptacle pod 400 may be similar to the previously discussed at least one receptacle pod(s) 120 of FIGS. 1 and 2. The receptacle pod 400 may be associated with an MMSR such as the MMSR 100 of FIG. 1. In some embodiments, the receptacle pod 400 can be molded of the same or similar semirigid material as the elongated, substantially planar structure 110 of FIG. 1, and/or primarily a textile material without a semirigid substrate material.

The receptacle pod 400 can include at least one closable opening 410 through which supplies can be stored and retrieved from within the interior volume 420. The closable opening 410 may be defined by a first side 412 and a second side 414. The first side 412 may connect with the second side 414 via a zipper 416. In some embodiments, the first side 412 may connect with the second side 414 via a hook and loop fastener, or any other suitable closure.

In some embodiments, the contents of the receptacle pod 400 can be efficiently retrievable via the closable opening 410. In some embodiments, the size of the closable opening 410 can be maximized by extending the closeable opening 410 beyond a meeting point 415 of the first side 412 and the second side 414 (e.g., the closable opening 410 may be formable by the upper edge and one or more adjacent side surfaces of the receptacle pod 400). Such an embodiment may beneficially facilitate ease of access to the interior volume 420 of the receptacle pod 400 and the contents therein. Furthermore, this content retrieval process may be accomplished while the receptacle pod 400 is attached to or detached from a MMSR.

The receptacle pod 400 can include one or more labels 450. The one or more labels 450 can include one or more color-coded label(s). In other embodiments, one or more labels 450 can include one or more reflective label(s). According to an embodiment, the one or more labels 450 can include both color-coded and reflective label(s). The one or more labels 450 can be permanently attached to the receptacle pod 400 via adhesion, sewing, or fusion or any other permanent attachment component. The one or more labels 450 can alternatively be temporarily attached via hook and loop fastener or any other temporary attachment component in order to be removable, modular, and interchangeable. The one or more labels 450 may beneficially enable the receptacle pod 400 to be customized to store a broad range and combination of organized contents.

In some embodiments, the one or more labels 450 allow for a user's rapid, intuitive identification of the respective contents therein. For example, the one or more labels may include labels for bleeding, airway, burns, orthopedic, specialty, topical, medications, blank labels to be custom-labeled by the end-user(s) based on their unique needs or preferences, and/or any other labels to identify contents.

In some embodiments, the receptacle pod 400 can have one or more lift tab(s) 460. The one or more lift tab(s) 460 may beneficially allow the expedited removal of the receptacle pod 400 from the MMSR when the receptacle pod 400 is temporarily connected to the MMSR. In some embodiments, the lift tab(s) 460 may further serve as lash tabs through which an attachment mechanism 465 such as a carabiner, clip, hook, hook and loop, or any other attachment component can attach to the receptacle pod 400. In other embodiments, the attachment mechanism 465 can couple the receptacle pod 400 to a backpack, purse, bicycle, vehicle, and/or the like, for separate, independent use of the receptacle pod(s) 400 apart from each other in a variety of practical scenarios, for example, when space may be limited but having medical supplies available is indicated, other supplies may not be necessary or needed, etc.

Figure 5B:
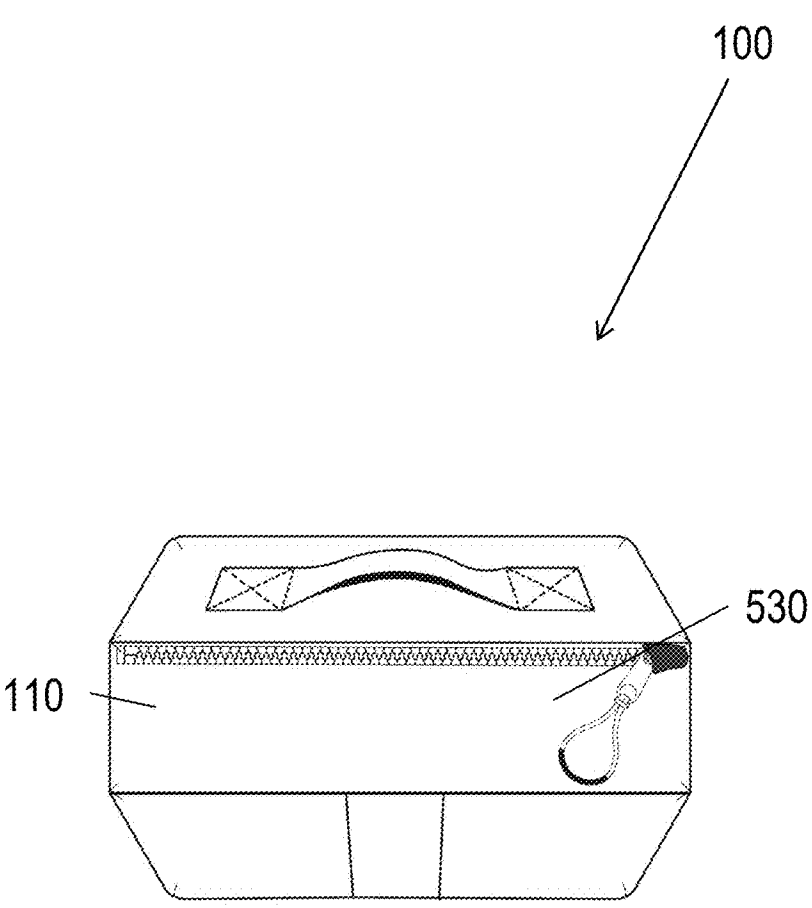
FIG. 5B illustrates a front view of a MMSR in an assembled/closed configuration, according to some embodiments.
Figure 5A:
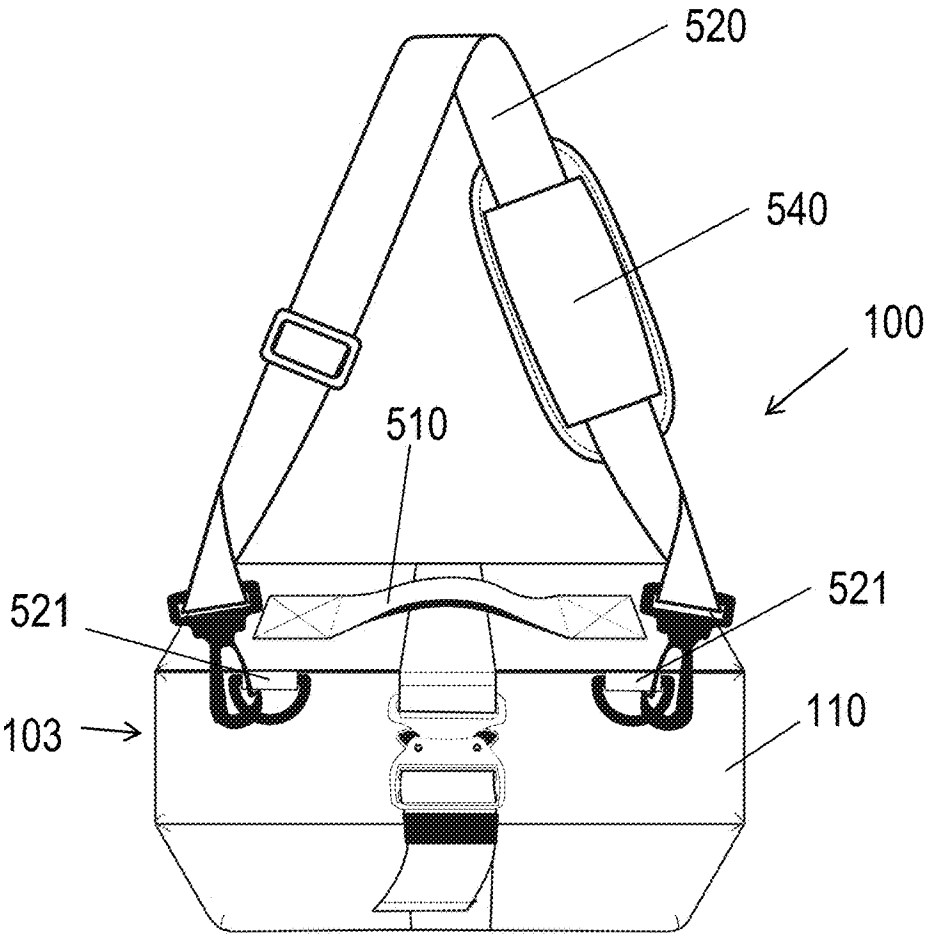
FIG. 5A illustrates a rear view of a MMSR in an assembled/closed configuration, according to some embodiments.

FIG. 5A illustrates a rear view of a MMSR 100 in the closed configuration, according to some embodiments. According to FIG. 5A, the elongated, substantially planar structure 110 can include a handle 510 on the second surface 103. In some embodiments, the elongated, substantially planar structure 110 can include one or more attachment point(s) 521 to which a detachable shoulder strap 520 can attach, or whereby a MMSR 100 may be hung. The handle 510, shoulder strap 520, and attachment point(s) 521, or the like, can provide a variety of convenient options for carrying or hanging MMSR 100 embodiments.

According to some embodiments, the detachable shoulder strap 520 can include an absorbent shoulder pad 540 that can be removably attached to the shoulder strap 520. The absorbent shoulder pad 540 may be used as an emergency pressure bandage with or without the shoulder strap 520 attached thereto.

Figure 6:
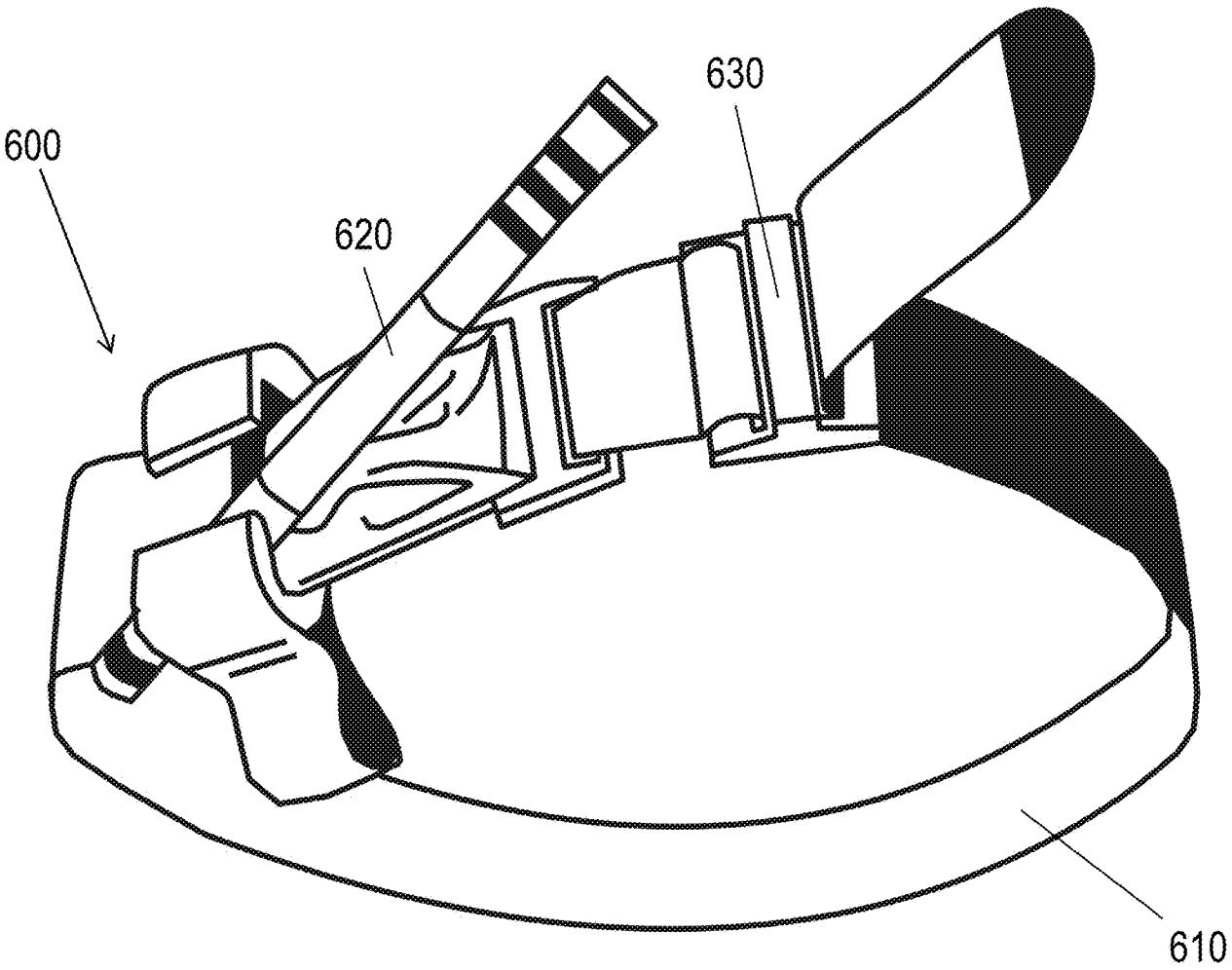
FIG. 6 illustrates an isometric view of a removable tourniquet, according to some embodiments.

In some embodiments, the detachable shoulder strap 520 can include rescue-grade nylon webbing and/or a tourniquet, for example, the tourniquet 600 of FIG. 6.

FIG. 5B illustrates a front view of an assembled MMSR 100, according to some embodiments. According to FIG. 5B, the assembled MMSR 100 can include one or more pockets 530 disposed on the elongated, substantially planar structure 110.

FIG. 6 shows an isometric view of a removable tourniquet 600, according to some embodiments. According to FIG. 6, a tourniquet 600 can be alternatively integrated as the tightening component 220 and connecting component 225 of FIG. 2. The tourniquet 600 can secure the MMSR 100 (not pictured) in the closed configuration. The tourniquet 600 may include at least a retentioning component 610 (which may be an adjustable-length tension strap), a connection component 630 (for example, a latch, clasp, buckle mechanism, or any other connecting component), and a tightening component 620 (for example a windlass, ratchet, or any other tightening component) to apply circumferential pressure.

According to an embodiment, the tourniquet 600 can secure an assembled MMSR in the closed configuration. In such an embodiment, the tourniquet 600 may wrap peripherally around and parallel longitudinally to the elongated, substantially planar structure 110 of the MMSR. The tourniquet 600 may then fasten with the connecting component 630. The connecting component 630 may be similar to the connecting component 225 of FIG. 2.

Furthermore, in some embodiments, the MMSR 100 may be selectably transformable or convertible from at least a storage apparatus into a different state or thing, the different state or thing being a plurality of medical and/or emergency devices, whereby clinical benefits and other advantages are achieved.

Turning now to FIGS. 7A-14B, some novel methods and processes of utilizing and operating various MMSR 100 embodiments as a plurality of medical and/or emergency devices according to the practices and broadly accepted procedures established by various healthcare regulatory bodies to achieve clinical benefits and other advantages are disclosed as follows.

In some embodiments, to selectably transform or convert a MMSR from at least a storage means apparatus to utilize the plurality of medical and/or emergency devices, a user may place a MMSR (for example, the MMSR 100 of FIGS. 1 and 2) on a surface (e.g., table, floor, etc.) or hang the MMSR vertically (e.g., on a wall, in a cabinet, from a headrest, etc.).

In some embodiments, wherein a MMSR 100 is secured in the closed configuration, the laterally-flexed elongated, substantially planar structure 110 may generate unreleased potential energy.

In some embodiments, the unreleased potential energy may be immediately transformed or converted into kinetic energy, responsive to releasing the tightening component 220 and/or the connection component 225 (e.g., conveniently utilizing one hand to release the connection component 225, etc.), whereby the elongated, substantially planar structure 110 surrounding the receptacle pod(s) 120 may unflex from the closed configuration and lay flat in an opened configuration before the user(s), thereby reducing the amount of valuable time needed to urgently access the receptacle pod(s) 120, and/or increasing the visibility of the color-coded and/or reflective label(s) 450 of FIG. 4 for rapid, intuitive visualization and identification of the categorized supplies therein.

In some embodiments, wherein a rescue-grade nylon webbing is utilized as the tightening component 220 and/or as the detachable shoulder strap 520, the rescue-grade nylon webbing may be removable from a MMSR 100, thereby providing usable length(s) of rescue-grade nylon webbing for short-distance rescue operations.

Figure 7B:
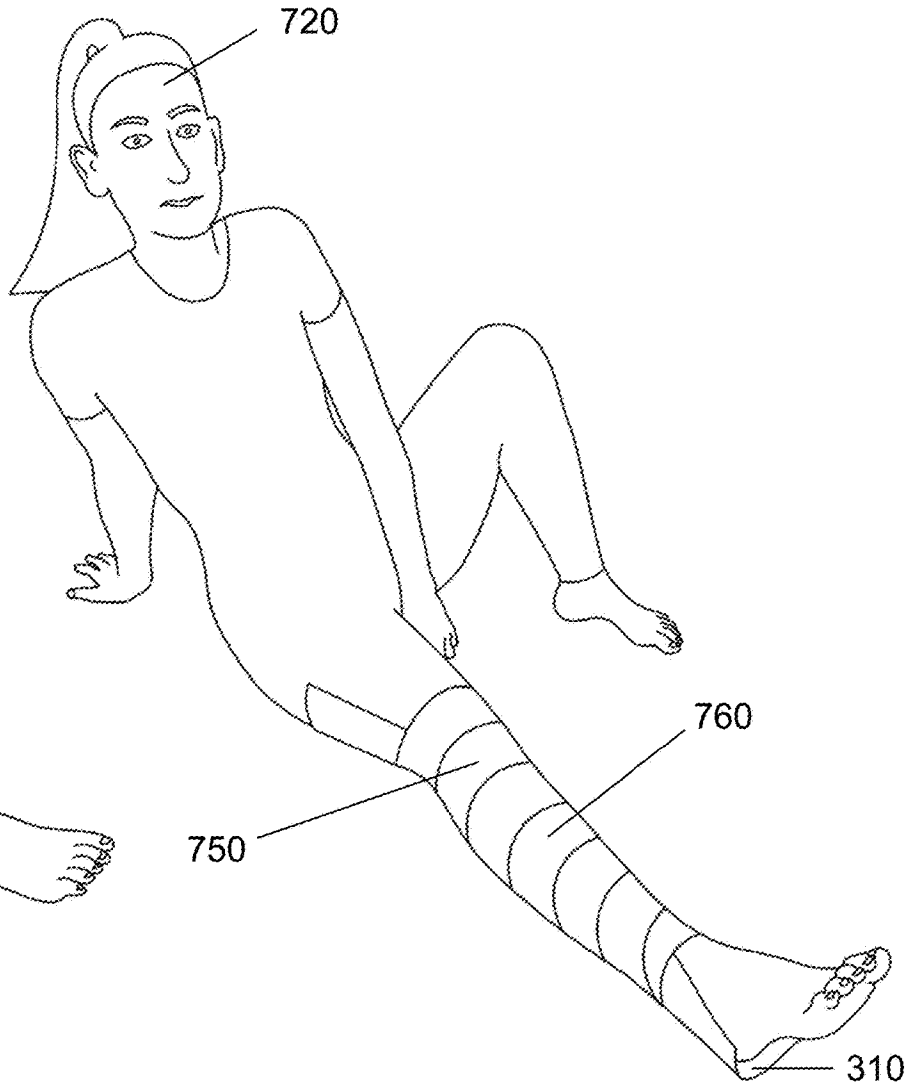
FIG. 7B illustrates an isometric view of a MMSR configured and utilized on the leg of a patient as an orthopedic extremity splinting device, according to some embodiments.
Figure 7A:
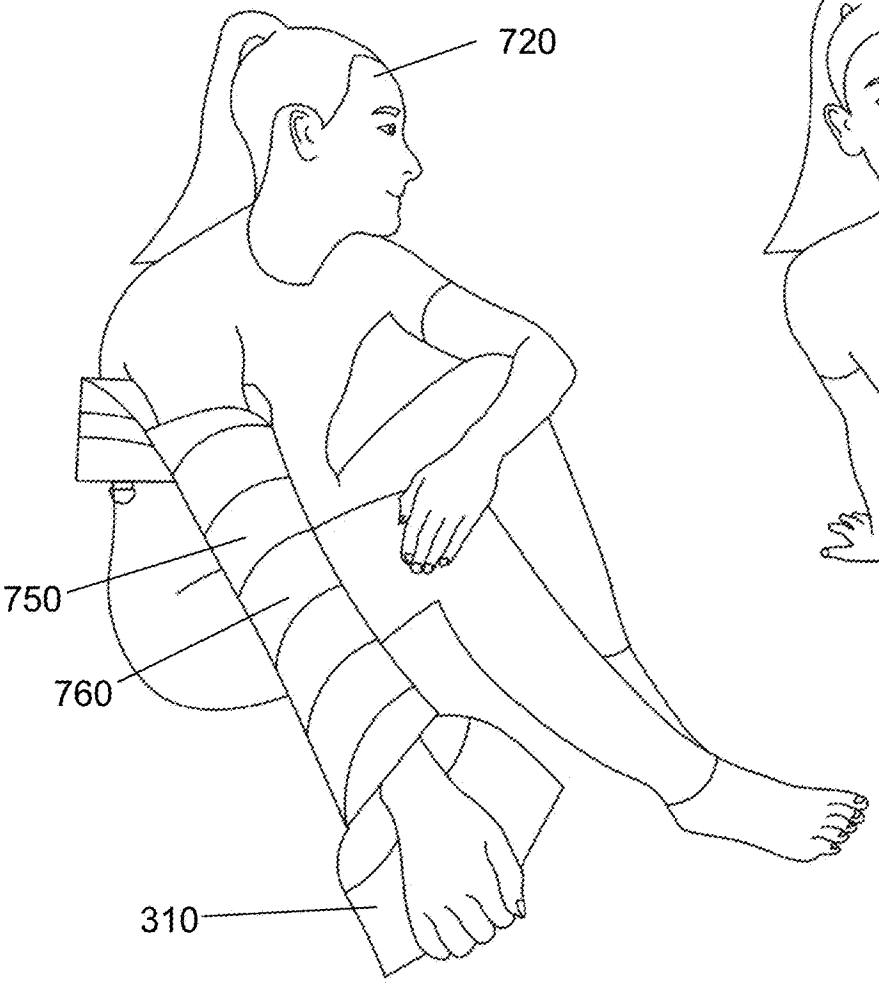
FIG. 7A illustrates an isometric view of a MMSR configured and utilized on the arm of a patient as an orthopedic extremity splinting device, according to some embodiments.

FIG. 7A and FIG. 7B show how a MMSR (such as the MMSR 300 of FIG. 3), according to some embodiments, may be selectably configured and utilized as an orthopedic immobilization device to immobilize or splint patient extremities (e.g., limbs, appendages, arms, legs, etc.), for example, in the event of bone or joint injuries (e.g., sprains, fractures, dislocations, etc.) needing an orthopedic splint device.

FIG. 7A and FIG. 7B illustrate isometric views of a MMSR applied on the limbs of patients as an orthopedic splinting device, according to some embodiments. For example, FIG. 7A shows an isometric view of a MMSR applied on the arm of a patient 720 as an orthopedic splinting device (or an orthopedic splint), according to some embodiments, and FIG. 7B shows an isometric view of a MMSR applied on the leg of a patient 720 as an orthopedic splinting device, according to some embodiments.

A method for using a MMSR as an orthopedic splint may selectably include one or more of the following actions, the like, or any combinations thereof. The method may include situating the elongated, substantially planar structure 310 to a patient 720 by aligning the longitudinal length of the substantially planar structure 310 parallel to the medial length of the injured body portion 750. The injured body portion 750 may be an extremity, a limb, an arm (as shown in FIG. 7A), a leg (as shown in FIG. 7B), an elbow, a knee, or any other body portion capable of being in need of an orthopedic splint.

In embodiments similar to the one shown and discussed in FIG. 3, the method may include fitting the elongated, substantially planar structure 310 to the injured body portion 750, according to the length of the patient's injured body portion 750, by reducing the effective length of the substantially planar structure 310. In some embodiments, this may include folding one of the one or more planar segment(s) 330 laterally against adjacent planar segment(s) 330 at the hinged linker(s) 340 (e.g., Z-folds, W-folds, accordion fold, etc.) to incrementally shorten the total length of the substantially planar structure 310 until the desired length is achieved, whereby a customizable fit for patients with different-sized extremities may be achieved.

The method may also include applying a lateral-bend, for example a flex, a curve, and/or a fold, across at least a portion of the total length of the elongated, substantially planar structure 310 while it is situated substantially against and around the patient's 720 injured body portion 750, thereby causing the elongated, substantially planar structure 310 to become longitudinally rigid/static (e.g., no longer able to bend dynamically lengthwise) responsive to wherever a lateral-bend is applied.

In some embodiments, the method may also include securing the applied lateral-bend of the elongated, substantially planar structure 310 in place against and around at least a portion of the injured body portion 750 by wrapping a retention component 760 circumferentially around the laterally bent elongated, substantially planar structure 310 and the injured body portion 750. The retention component 760 may include a gauze bandage, the removable tightening component 220 of FIG. 2 of the MMSR 100, the removable tourniquet 600 of FIG. 6 of the MMSR, the detachable shoulder strap 520, or any other suitable retention component. Such a method may beneficially enable the elongated, substantially planar structure 310 to maintain its longitudinal rigidity for immobilization of joints or bones above and below the injured body portion 750 to which the substantially planar structure 310 is applied, resulting in an effective orthopedic splinting device.

In some embodiments, a user may use an additional retention component 760 to further immobilize and support the injured body portion 750 in a position of comfort.

Figure 8A:
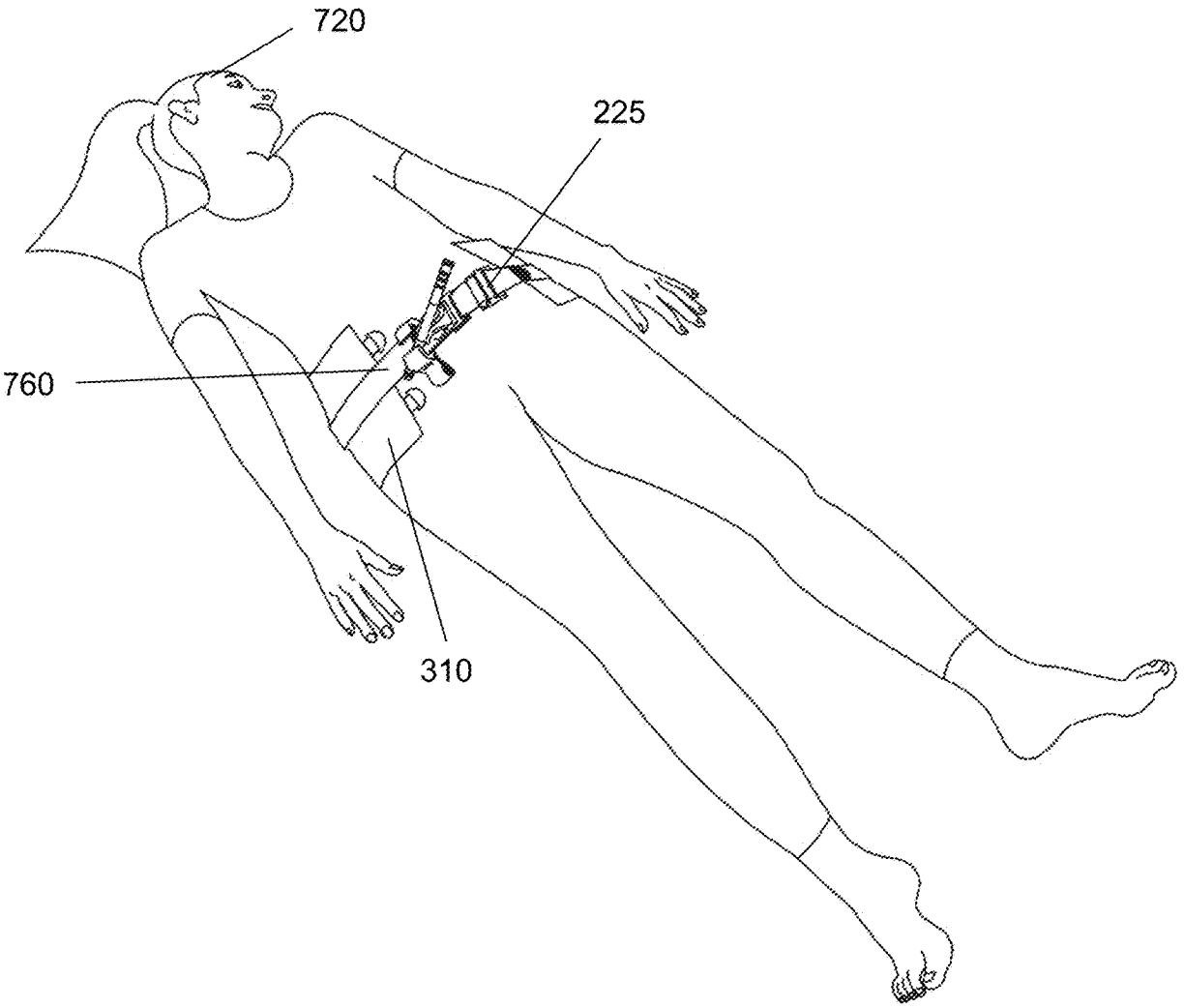
FIG. 8A illustrates an isometric view of a MMSR configured and utilized on a patient's hips as an orthopedic pelvic binder device, according to some embodiments.

FIG. 8A illustrates an isometric view of an MMSR applied on the hips of a patient 720 as an orthopedic pelvic binder device, according to some embodiments. In the event of a pelvic injury, such as a sprain, fracture or dislocation needing orthopedic splinting (or binding), the unbent elongated, substantially planar structure 310 can be utilized as an orthopedic pelvic binder device to support the injury.

According to FIG. 8A, a method and process for using an MMSR as a pelvic immobilization device can include one or more of the following actions, the like, or any combinations thereof.

The method may include wrapping the elongated, substantially planar structure 310 circumferentially around the patient's 720 hips, centered medially over the greater trochanters (e.g., the projection of the pelvis and upper thigh bone on each side of the body, etc.).

In embodiments similar to the one shown and discussed in FIG. 3, the method may include fitting the elongated, substantially planar structure 310 to the patient's 720 hips, according to the circumferential size of the patient's 720 hips, by reducing the effective length of the substantially planar structure 310. In some embodiments, this may include folding one of the one or more planar segment(s) 330 laterally against adjacent planar segment(s) 330 at the hinged linker(s) 340 (e.g., Z-folds, W-folds, accordion fold, etc.) to incrementally shorten the total length of the substantially planar structure 310 until the desired length is achieved, whereby a customizable fit for patients with different-sized hips may be achieved.

In some embodiments, the method may include securing the elongated, substantially planar structure 310 around the patient's 720 hips, centered medially over the greater trochanters, by wrapping a retention component 760 peripherally around and parallel longitudinally to the elongated, substantially planar structure 310. The retention component 760 may include a gauze bandage, the tightening component 220 of FIG. 2 of the MMSR, the tourniquet 600 of FIG. 6 of the MMSR, the detachable shoulder strap 520, or any other suitable retention component.

The method may also include fastening the substantially planar structure 310 in a closed configuration circumferentially around the patient's 720 hips over the greater trochanters with a connecting component 225 proximate the opposing lateral edges.

The method may further include tightening the retention component 760 circumferentially until the desired circumferential pressure to support the pelvic injury is achieved.

Figure 8B:
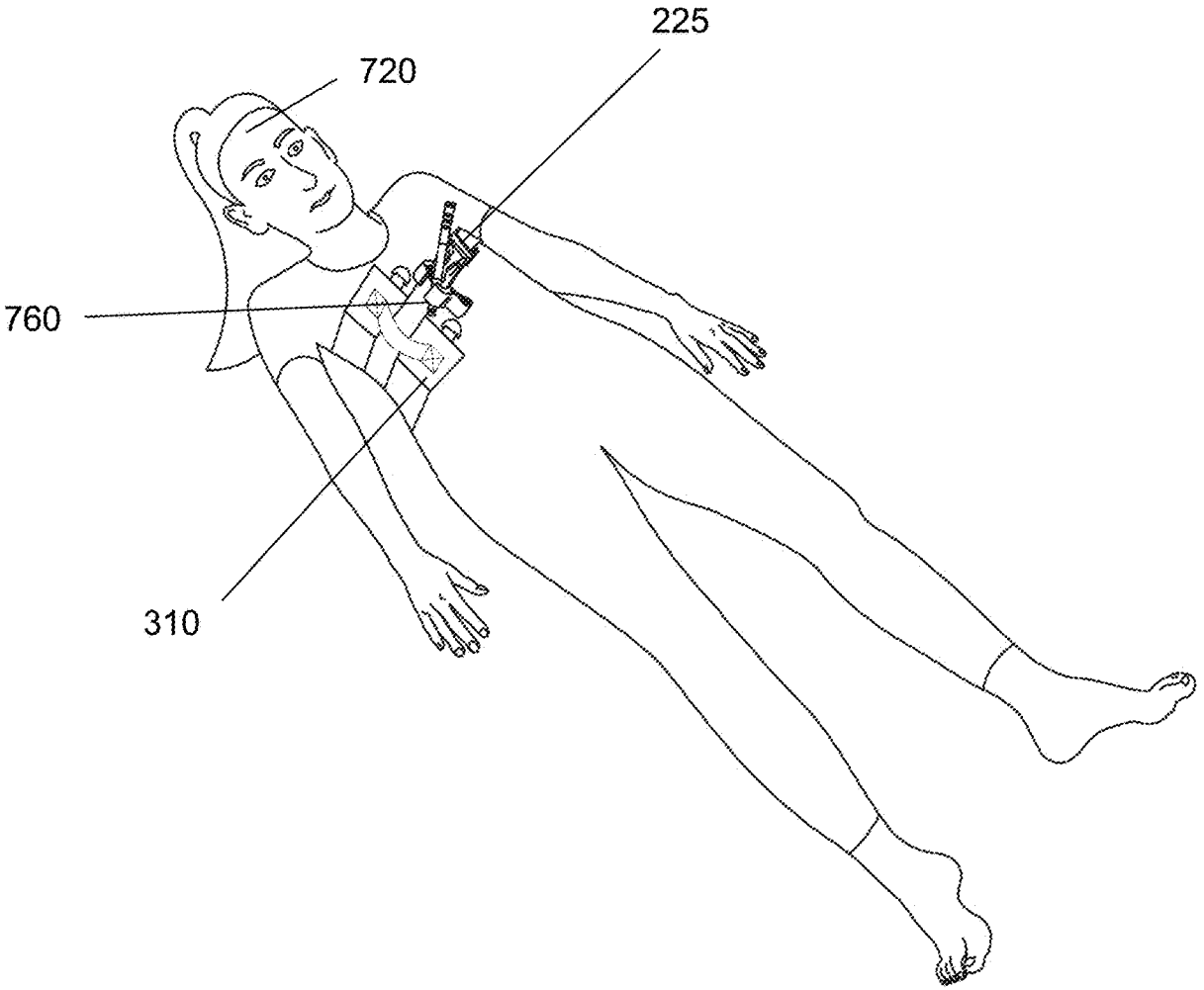
FIG. 8B illustrates an isometric view of a MMSR configured and utilized on a patient's chest as an orthopedic thoracic splint device, according to some embodiments.

FIG. 8B shows an isometric view of an MMSR applied on a patient's 720 chest as an orthopedic thoracic splint device, according to some embodiments. A similar method as discussed in regard to FIG. 8A can be applied in FIG. 8B to achieve the desired circumferential pressure to support thoracic injuries, for example, in the event of fractured ribs and/or flail chest injuries needing a thoracic splint device.

Figure 9B:
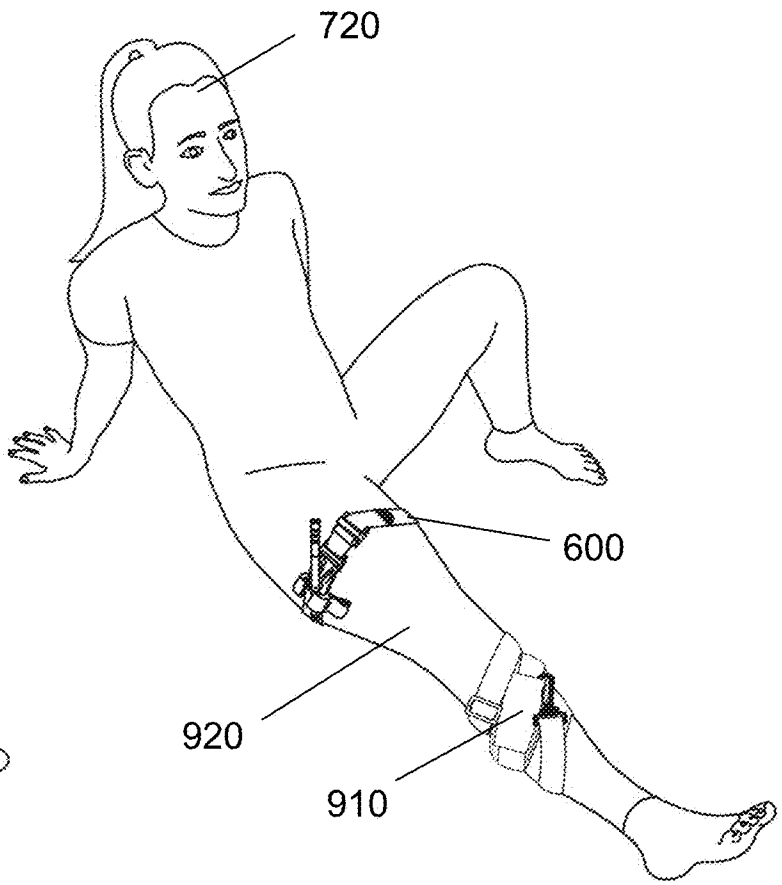
FIG. 9B illustrates an isometric view of a MMSR and a removable tourniquet configured and utilized on the leg of a patient as a bleeding control device, according to some embodiments.
Figure 9A:
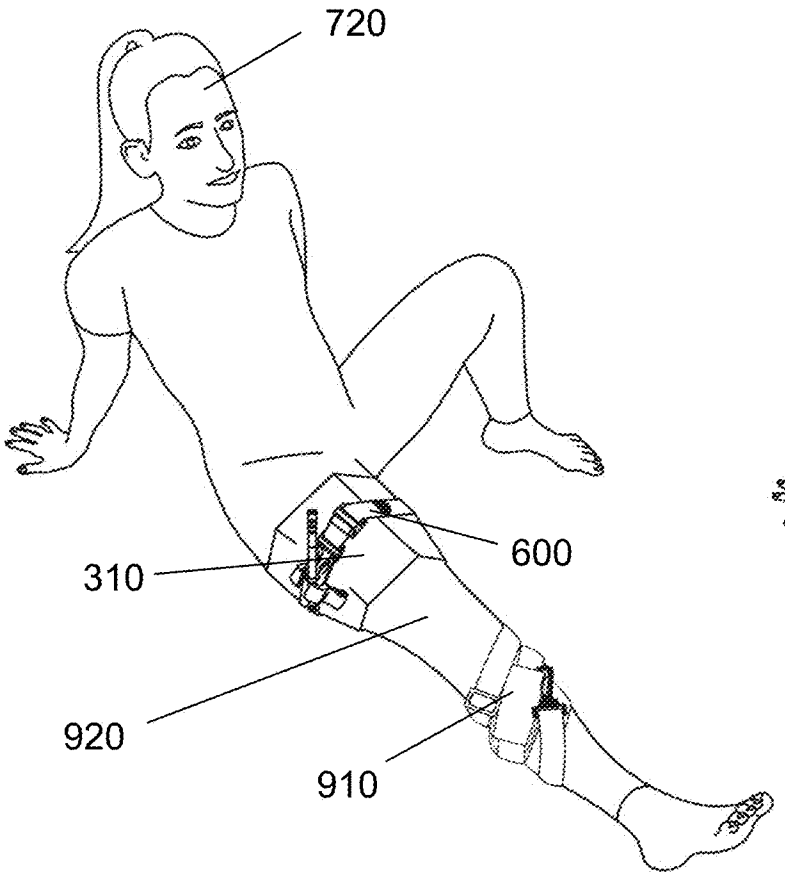
FIG. 9A illustrates an isometric view of a MMSR and a removable tourniquet configured and utilized on the leg of a patient as a bleeding control device, according to some embodiments.

FIG. 9A illustrates an isometric view of an MMSR and removable tourniquet applied on the leg of a patient as a bleeding control device, according to some embodiments.

In the event of a hemorrhaging injury, such as an extremity with a profuse bleeding injury site 910 needing a tourniquet device, the unbent elongated, substantially planar structure 310 and a tightening component 220 (for example, the tourniquet 600 of FIG. 6) can be utilized as a tourniquet device. The substantially planar structure 310 can increase the effective surface area used during tourniquet application. This method and process can help reduce soft tissue, tendon, and nerve damage by distributing the pressure exerted responsive to a tourniquet being compressed circumferentially around an injured limb to occlude distal bleeding, as shown at least in FIG. 9A.

In some embodiments, the method of using a MMSR as a tourniquet device may include one or more of the following actions, the like, or any combinations thereof.

Some methods may include fitting the elongated, substantially planar structure 310 to the patient's 720 injured limb 920, according to the circumferential size of the patient's limb 920, by reducing the effective length of the substantially planar structure 310. In some embodiments, this may include folding one of the one or more planar segment(s) 330 laterally against adjacent planar segment(s) 330 at the hinged linker(s) 340 (e.g., Z-folds, W-folds, accordion fold, etc.) to incrementally shorten the total length of the substantially planar structure 310 until the desired length is achieved, whereby a customizable fit for patients with different-sized limbs 920 may be achieved.

In some embodiments, the method includes wrapping the unbent elongated, substantially planar structure 310 circumferentially around an injured limb 920 proximal to the injury site 910.

In some embodiments, the method can include tightening the tightening component 220 or the tourniquet 600 circumferentially around the elongated, substantially planar structure 310 to compress the hemorrhaging vein or artery until the distal bleeding is controlled.

FIG. 9B illustrates isometric views of the detachable shoulder strap 520, the absorbent shoulder pad 540, and removable tourniquet applied on the limbs of a patient 720 as bleeding control devices, according to some embodiments. As shown in FIG. 9B, a user may apply the tourniquet 600 to the injured limb 920 independently of the elongated, substantially planar structure 310.

In any MMSR method or process of use involving bleeding or any other injury needing a bandage, the detachable shoulder strap 520, and/or the absorbent shoulder pad 540 may be applied to the bleeding injury site 910 as an emergency pressure bandage to help slow or control bleeding further, as demonstrated by reference 910 in FIGS. 9A and 9B.

Figure 10B:
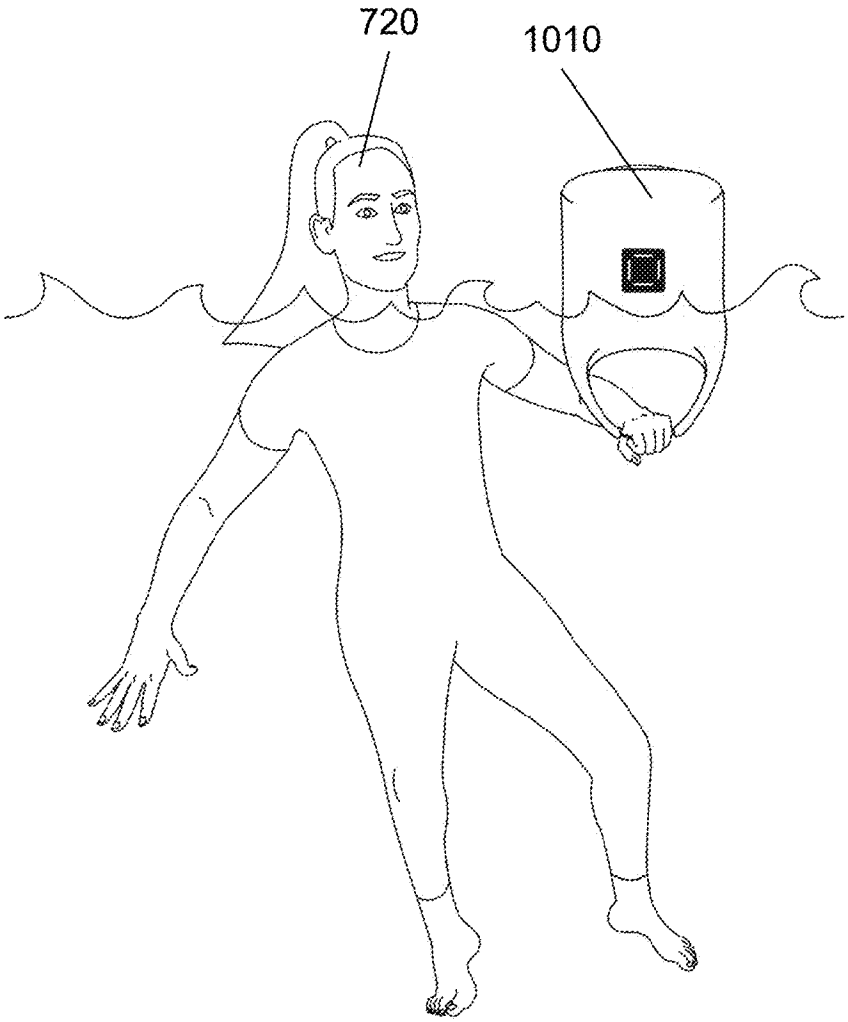
FIG. 10B illustrates an isometric view of a patient utilizing the buoyant waterproof drybag cover as an improvised emergency floatation device, according to some embodiments.
Figure 10A:
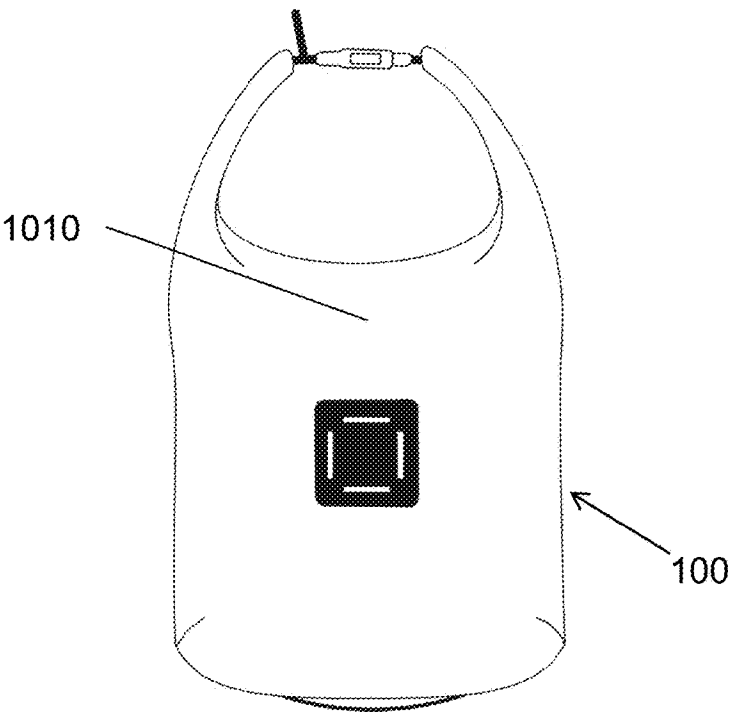
FIG. 10A illustrates an isometric view of a buoyant waterproof drybag cover, according to some embodiments.

FIG. 10A illustrates an isometric view of a buoyant waterproof drybag cover 1010, according to one or more embodiments. A MMSR 100 may be stored inside the buoyant waterproof drybag cover 1010, thereby protecting a MMSR 100 or components thereof from wear and tear, for example, during use outdoors in inclement weather or other adverse environments.

FIG. 10B illustrates an isometric view of a buoyant waterproof drybag cover 1010 and a patient 720 utilizing the buoyant waterproof drybag cover 1010 as an improvised emergency floatation device, according to one or more embodiments.

In some embodiments, a MMSR 100 may be mobilized or deployed for use in various emergency scenarios by utilizing the handle 510, the detachable shoulder strap 520, the buoyant waterproof drybag cover 1010, and/or another carrying component.

In some embodiments, the buoyant waterproof drybag cover 1010, can store one or more receptacle pod(s), for example the receptacle pod 400 of FIG. 4, responsive to the one or more receptacle pod(s) 400 being separated from the elongated, substantially planar structure 310 while the elongated, substantially planar structure 310 may be utilized as one or more of the plurality of medical and/or emergency devices discussed herein, and/or the like.

In some embodiments, the buoyant waterproof drybag cover 1010 can be secured closed with air trapped therein, with or without an MMSR stowed inside, to be used as an improvised emergency floatation device, as shown at least in FIG. 10B.

In some embodiments, the buoyant waterproof drybag cover 1010 may be collapsable and disposable of inside an MMSR, and vice versa.

Figure 11:
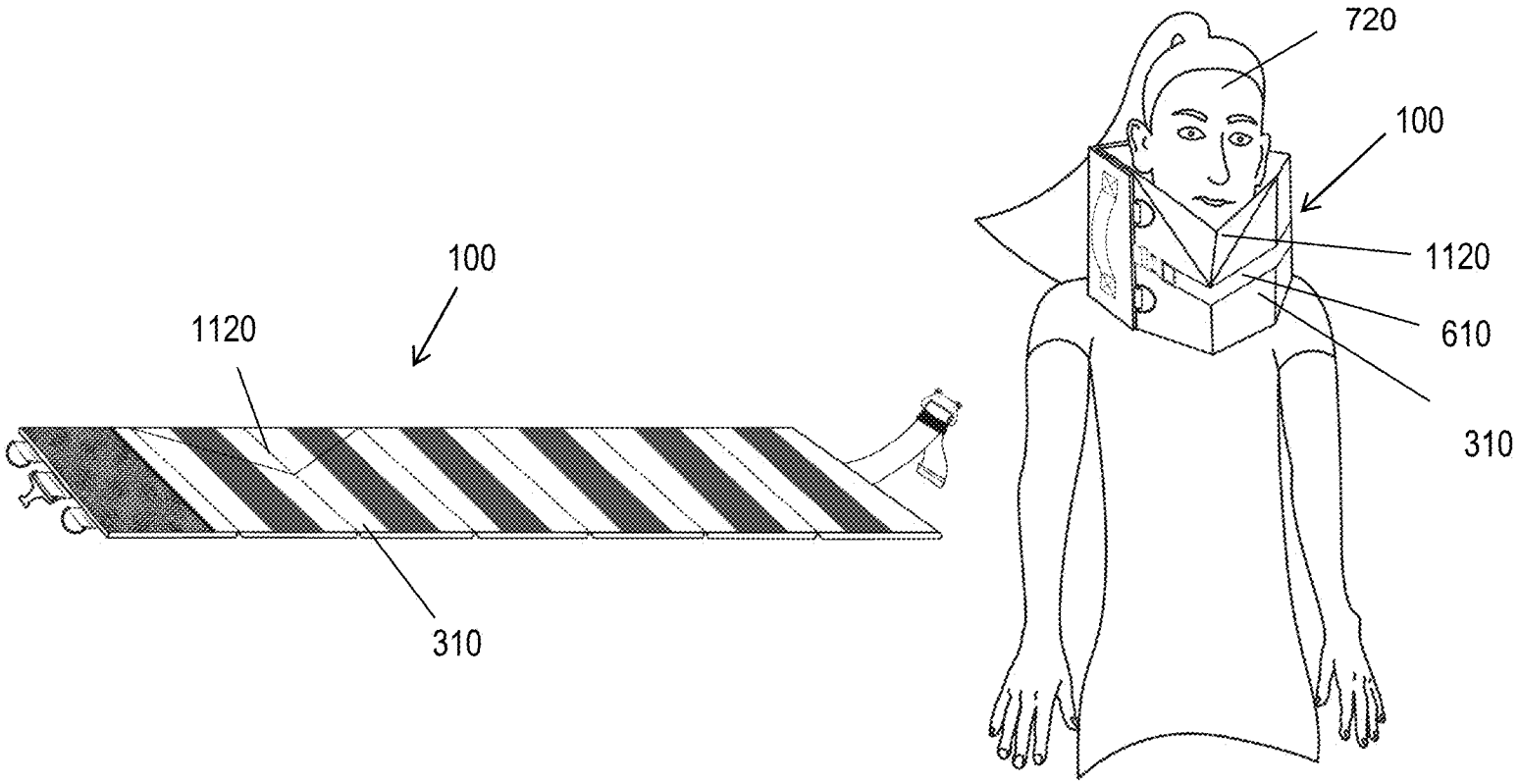
FIG. 11 illustrates an isometric view of a MMSR configured and utilized on the neck of a patient as an orthopedic cervical collar device, according to some embodiments.

FIG. 11 illustrates an isometric view of an MMSR applied on the neck of a patient as an orthopedic cervical collar device, according to some embodiments. According to FIG. 11, an MMSR 100 can be used as an orthopedic immobilization device to stabilize the head, neck, and cervical segment of a patient's spinal column. In some embodiments, a method and process for using an MMSR 100 includes one or more of the following actions, the like, or any combinations thereof.

Some methods include situating the elongated, substantially planar structure 310 beneath the head, neck, and cervical segment of the spinal column of a patient 720, centered longitudinally/lengthwise and perpendicularly to the midline of the patient 720.

In some embodiments, the method can include fitting the elongated, substantially planar structure 310 to the neck of the patient, according to the circumferential or perimeter size of the neck of the patient, by utilizing only the substantially planar segment(s) needed to adequately surround the neck of the patient, whereby a customizable fit for patients with different-sized necks may be achieved.

In some embodiments, the method can include wrapping the elongated, substantially planar structure 310 longitudinally or lengthwise and circumferentially around the perimeter of the neck of the patient, with at least one hingeable notch 1120 positioned beneath the patient's jaw and chin, thereby stabilizing the head and neck in a neutral, midline position to prevent further injury, whereby immediate pain relief and other clinical benefits may be provided to the patient 720. The hingeable notch 1120 may be disposed on the elongated, substantially planar structure 310, and suitably be a U-shaped or V-shaped cutout, alternatively.

Some actions may comprise securing the elongated, substantially planar structure 310 in place circumferentially around the perimeter of the neck of the patient 720 with a temporary attachment component (e.g., hook and loop, clips, hooks, adhesive, etc.) therebetween connecting substantially planar segment(s) 330, and/or by wrapping a retentioning component 610 (e.g., gauze bandage, pressure bandage, the tightening component 220, extremity tourniquet device 600, detachable shoulder strap 520, etc.) circumferentially around, and parallel longitudinally/lengthwise to, the second surface 303 of the elongated, substantially planar structure 310.

In some embodiments, the method can include placing removable receptacle pod(s) on the lateral sides of the patient's head and neck, thereby further stabilizing and padding the head and neck in a neutral, midline position to prevent further injury.

Figure 12B:
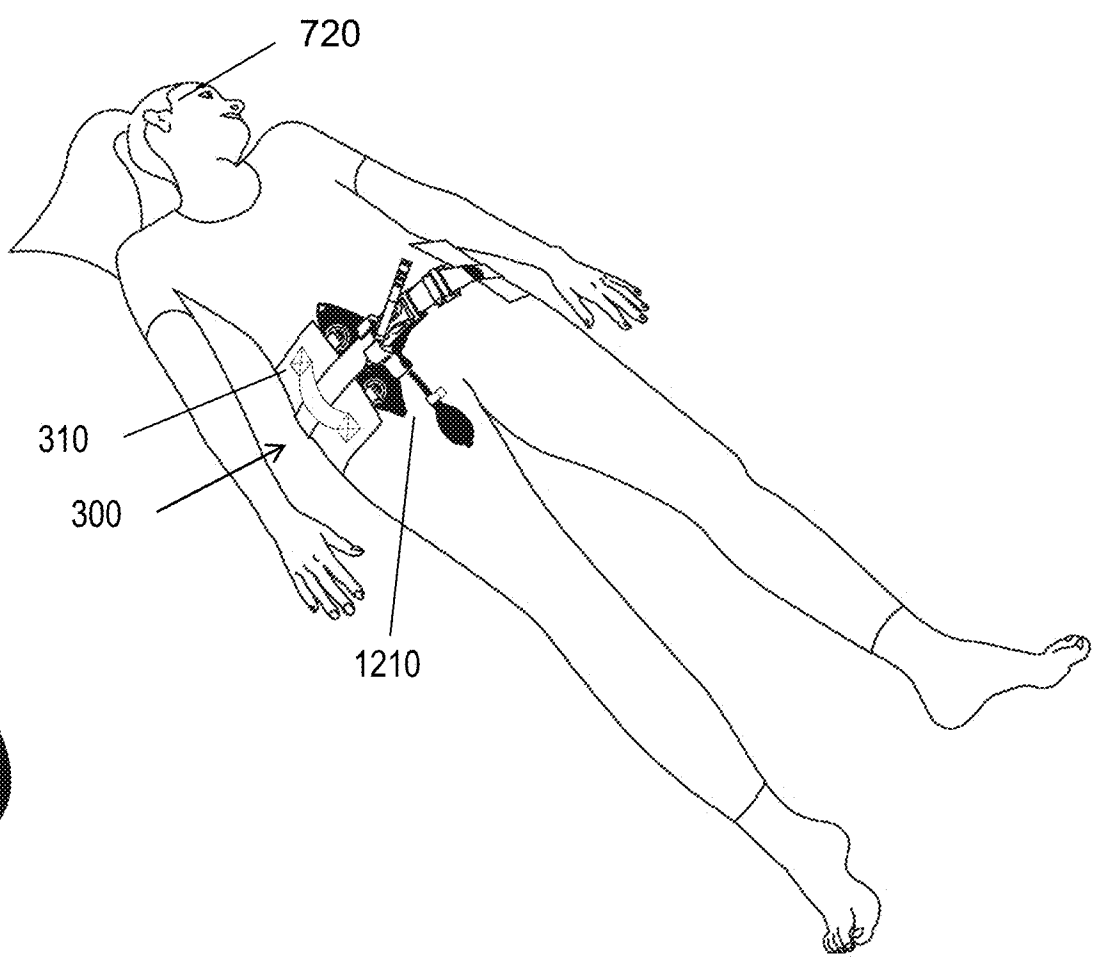
FIG. 12B illustrates an isometric view of a MMSR and an expandable separator device configured and utilized on the pelvis/hips of a patient as a junctional tourniquet device, according to some embodiments.
Figure 12A:
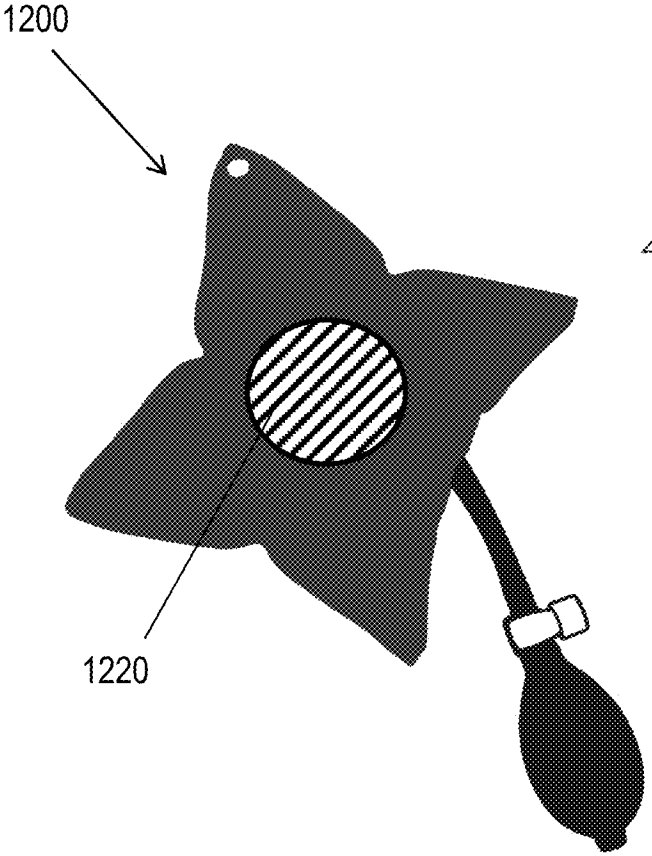
FIG. 12A illustrates an isometric view of an expandable separator device, according to some embodiments.

FIG. 12A illustrates an isometric view of an expandable separator device, according to some embodiments. An expandable separator may be a manually inflatable pneumatic shim or wedge, blood pressure cuff, or any other suitable component or device capable of being expanded. FIG. 12B illustrates an MMSR applied on the pelvis/hips of a patient as a junctional tourniquet device, according to some embodiments. According to FIG. 12A and FIG. 12B, the expandable separator device 1200 can be attached to an MMSR 100. The expandable separator device 1200 may be removably attached to the MMSR 100 by an attachment component 1220 such as hook and loop fastener, or any other means of removable attachment. The expandable separator device 1200 may be permanently attached to the MMSR. The expandable separator device 1200 can be disposed in between the MMSR 100 and a patient 720. The expandable separator device 1200 may be stored in a receptacle pod attached to the MMSR 100.

In some embodiments, a method and process of using an MMSR 100 includes using the MMSR 100 as a junctional tourniquet to control junctional bleeding (e.g., the connecting area between the torso or trunk and extremities, shoulders/armpits/axilla, hips/groin, etc.) of a patient 720. As shown in FIG. 12B, the method can include one or more of the following actions, the like, or any combinations thereof.

Some methods may include fitting the elongated, substantially planar structure 310 to the hemorrhaging junctional injury site 1210, according to the circumferential size of the patient's 720 thorax (for junctional bleeding in the shoulder/armpit/axilla areas), or hips (for junctional bleeding in the groin areas), by reducing the effective length of the substantially planar structure 310. In some embodiments, this may include folding the one or more planar segment(s) 330 laterally against adjacent planar segment(s) 330 at the hinged linker(s) 340 (e.g., Z-folds, W-folds, accordion fold, etc.) to incrementally shorten the total length of the substantially planar structure 310 until the desired length is achieved, whereby a customizable fit for patients with different-sized thoraxes and/or hips may be achieved.

The method can include situating the expandable separator device 1200 proximal to the hemorrhaging junctional injury site 1210 over the hemorrhaging junctional artery and/or vein, and therebetween the patient and the elongated, substantially planar structure 310 and/or the tightening component 220.

The method can include tightening a tightening component 220 until a predetermined amount of pressure is achieved around the perimeter of the patient's bleeding junction.

In some embodiments, the method can include expanding the expandable separator device 1200 and directly compressing against the hemorrhaging junctional artery and/or vein until the distal bleeding from the hemorrhaging junctional injury site 1210 is controlled.

Figure 13A:
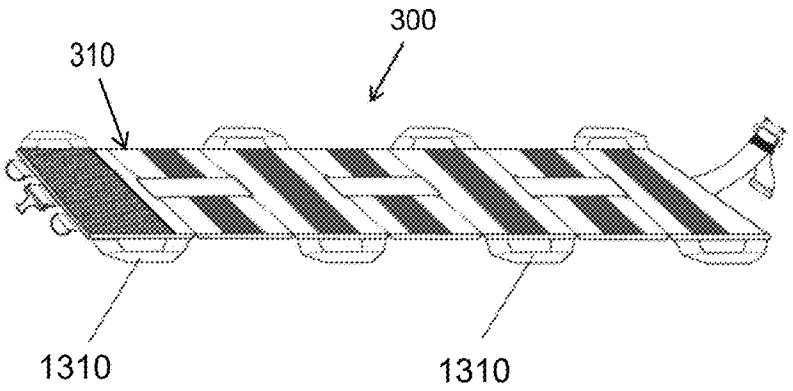
FIG. 13A illustrates an isometric view of a MMSR configured as a patient transport device, according to some embodiments.
Figure 13B:
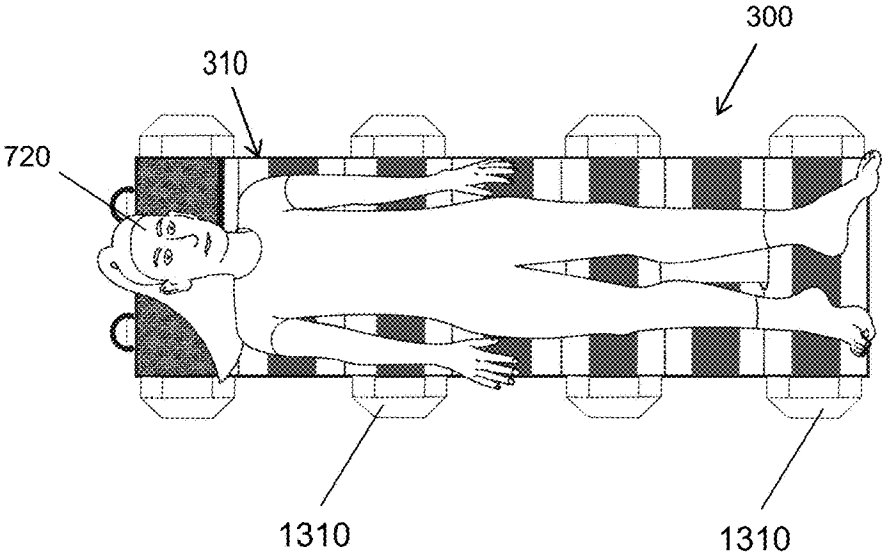
FIG. 13B illustrates an isometric view of an MMSR configured and utilized as a patient transport device to transport a patient, according to some embodiments.

FIG. 13A illustrates an isometric view of an MMSR configured as a patient transport device, according to some embodiments. FIG. 13B illustrates an isometric view of an MMSR configured as a patient transport device and a patient, according to some embodiments.

According to FIG. 13A and FIG. 13B, an MMSR 300 may be of a size that is sufficient to be utilized as a transport device. For example, the transport device may be a litter or a stretcher to carry or transport a patient 720. In some embodiments, the MMSR 300 includes one or more transport handles 1310. The one or more transport handles 1310 may enable the MMSR 300 to provide the benefits of a patient transport device.

In some embodiments, the MMSR 300 may become longitudinally rigid or static responsive to the weight of a patient 720 laterally flexing the elongated, substantially planar structure 310 while being carried or transported thereon. At least in such a way the MMSR 300 may enable the benefits of a transport device while providing a collapsable transport device that reduces its size, allowing for compact storing and increased portability.

Figure 14B:
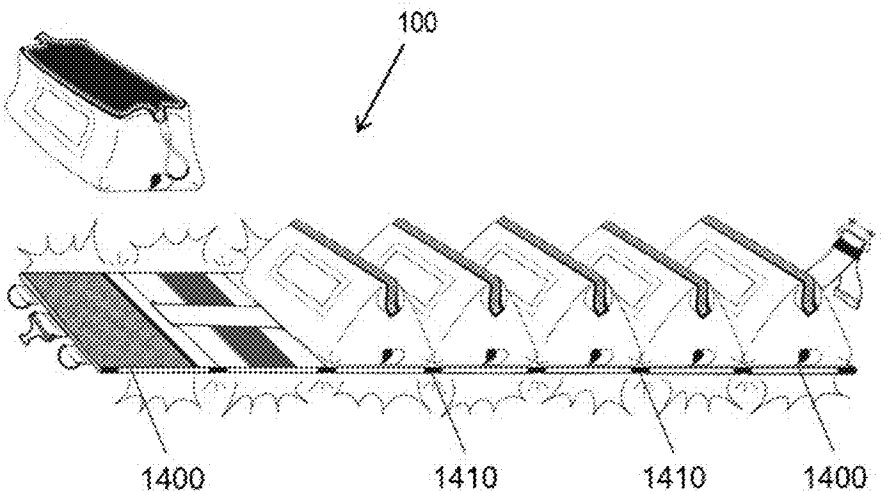
FIG. 14B illustrates an isometric view of a MMSR in an opened configuration that is configured and utilized as an emergency lighting device, according to some embodiments.
Figure 14A:
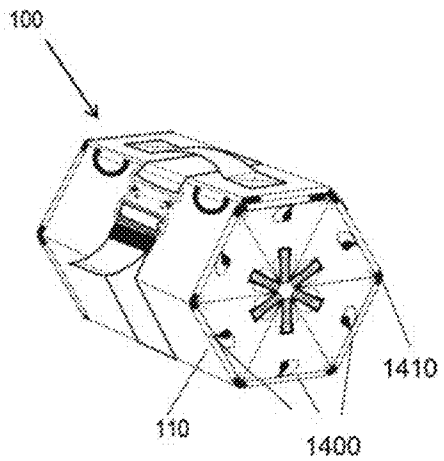
FIG. 14A illustrates an isometric view of a MMSR in an assembled/closed configuration that is configured as an emergency lighting device, according to some embodiments.

FIG. 14A illustrates an isometric view of a MMSR in a closed configuration that is configured as an emergency lighting device, according to some embodiments. FIG. 14B illustrates an isometric view of a MMSR in an open configuration that is configured as an emergency lighting device, according to some embodiments. According to FIG. 14A and FIG. 14B, one or more illumination devices 1400 may be attached to at least one of the surfaces and/or opposing longitudinal/lateral ends or edges of the elongated, substantially planar structure 110. The illumination devices may include glow sticks, chem lights, LED light sources, or any other illuminating device.

The one or more illumination devices 1400 may be removably attached to at least one of the surfaces or edges of the substantially planar structure 110. In at least this way, the illumination devices 1400 may be removed to provide lighting in various environments, for example low-light or no-light emergency situations.

The one or more illumination devices 1400 may have a shape that corresponds to the shape formed by the opposing longitudinal edges of the elongated, substantially planar structure 110. The illumination devices may be removably attached to the elongated, substantially planar structure 110 by passing the illumination devices 1400 through one or more specialized feeding components 1410 that enables the illumination devices 1400 to not be bent, activated, and/or illuminated prematurely. According to some embodiments, the illumination devices 1400 may be automatically activated by changing the MMSR 100 from a closed configuration to an open configuration, as shown in FIGS. 14A and 14B. According to some embodiments, the illumination device 1400 may be activated responsive to moving the MMSR from an assembled configuration (for example, the configuration shown in FIG. 2) to an opened configuration (for example, the configuration shown in FIG. 1).

In some embodiments, after the plurality of medical and emergency devices may no longer be needed by the user(s) and/or patient(s), the multifunctionalities of a MMSR 100 may be reapplied or reutilized.

In some embodiments, a MMSR 100 may further contain instructions (e.g., booklets, pamphlets, labels, etc.) with descriptions, explanations, and/or illustrations demonstrating one or more of the methods/processes of utilizing a MMSR 100 as one or more of the plurality of medical and/or emergency devices. In some embodiments, the instructions may be displayed (e.g., sew-on labels/tags, screen-printing, sublimation, embroidery, heat transfer, etc.) directly on the material of a MMSR 100. In some embodiments, the instructions may be color-coded and/or reflective for improved visualization and identification by the user(s), whereby the user(s) may more efficiently execute the methods/processes of utilizing a MMSR 100, especially under the stress of an emergency when time is of the essence.

The embodiments described herein at least show how to successfully integrate the independent utilitarian functions of a storage receptacle and at least one of a plurality of medical and/or emergency devices, including but not limited to, an orthopedic splint device, a pelvic binder device, a thoracic splint device, a cervical collar device, an extremity and junctional tourniquet device, an emergency pressure bandage, an improvised emergency floatation device, an immobilized patient transport device, an emergency lighting system, and/or the like into a self-contained, multifunctional apparatus, thereby achieving new, unconventional, and non-obvious synergistic advantages never before appreciated, and not otherwise achieved, by any one of the existing conventional systems and solutions referenced alone. Some additional unordinary advantages of a MMSR are provided as follows.

In some embodiments, a MMSR provides usable storage space within the apparatus while preserving the same usable storage space by being in and of itself operable as a plurality of medical and/or emergency devices that would otherwise be separate, stand-alone components consuming storage space within a conventional medical supply receptacle.

In some embodiments, the new, unexpected advantages achieved by a MMSR enable the size of a MMSR to be reduced to considerably small sizes without losing or sacrificing clinical or emergency functions.

In some embodiments, the space-saving attributes and multifunctionalities of a MMSR may further enable a MMSR to be utilized in a wide range of practical scenarios, for example, in prehospital emergency medical situations, wherein storage space for medical and emergency supplies may be inconveniently limited or otherwise impractical for conventional systems and solutions. Consequently, the unapparent inventions/innovations of a MMSR, and its resultant new, unexpected advantages, address large, unfilled, and long-felt needs.

The terminology used herein is for the purpose of describing particular embodiments only and is not intended to be limiting of the present disclosure. It will be further understood that the terms "includes," "including," "comprises," and/or "comprising" as used in this specification specify the presence of stated features, elements, components, steps, or operations, but do not preclude the presence of one or more other features, elements, components, or operations.

Unless otherwise defined, all terms (including technical and scientific terms) used in this specification have the same meaning as commonly understood by one having ordinary skill in the applicable arts. It will be further understood that terms should be interpreted as having a meaning that is consistent with their meaning in the context of the relevant arts and the present disclosure and will not be interpreted in an idealized or overly formal sense unless expressly so defined in this specification.

A number of operations, materials, and techniques are disclosed in this specification. Each of these concepts has individual benefits and each can be used in conjunction with one or more, or all, of the other disclosed operations, materials, and techniques. Each possible combination will not be separately described, but the specification should be read with the understanding that such combinations are within the scope of the present disclosure and the claims.

Any of the features, embodiments, and functionalities of the present disclosure may be used in conjunction with each other. Similar features in different embodiments may have the same or similar structure, advantages, and/or functionalities as similar features in other embodiments.

The above description of illustrated implementations of the present disclosure is not intended to be exhaustive or to limit the disclosure to the precise forms disclosed. While specific implementations of, and examples for, the present disclosure are described herein for illustrative purposes, various equivalent modifications are possible within the scope of the disclosure, as those skilled in the relevant arts will recognize.

Various operations are described as multiple discrete operations, in turn, in a manner that is most helpful in understanding the present disclosure, however, the order of description should not be construed to imply that these operations are necessarily order dependent. In particular, these operations need not be performed in the order of presentation.

The terms "over," "under," "between," "disposed on," and "on" as used herein refer to a relative position of one material layer or component with respect to other layers or components. For example, one layer disposed on, over, or under another layer may be directly in contact with the other layer or may have one or more intervening layers. Moreover, one layer disposed between two layers may be directly in contact with the two layers or may have one or more intervening layers. Similarly, unless explicitly stated otherwise, one feature disposed between two features may be in direct contact with the adjacent features or may have one or more intervening layers.

Various embodiments can have different combinations of the structural features described above.

While the present disclosure has been described with respect to a limited number of embodiments, those skilled in the relevant arts will appreciate numerous modifications and variations therefrom. It is intended that the appended claims cover all such modifications and variations as fall within the true spirit and scope of this present disclosure.

In the description herein, numerous specific details are set forth, such as examples of specific types of materials, specific sizes, specific surfaces, specific structures, specific details, specific configurations, specific types, specific system components, specific operations, etc. in order to provide a thorough, proficient understanding of the present disclosure without undue experimentation or effort. It will be apparent, however, to one skilled in the relevant arts that these specific details need not be employed to practice the present disclosure. In other instances, well-known components or methods/processes, such as specific and alternative materials, sizes, surfaces, structures, details, configurations, types, system components, operations, etc. have not been described in greater detail in order to avoid unnecessarily obscuring the present disclosure.

Although some of the embodiments herein are described with reference to an MMSR, other embodiments are applicable to other types of devices. Similar techniques and teachings of embodiments of the present disclosure can be readily applied to other types of structures and surfaces that can benefit from simultaneous functionality as a medical and storage device. In addition, the description herein provides examples, and the accompanying drawings demonstrate various examples for the purposes of illustration. However, these examples should not be construed in a limiting sense as they are merely intended to provide examples of embodiments of the present disclosure rather than to provide an exhaustive or all-inclusive list of each and every embodiment implementation possible from the present disclosure.

As used herein, the terms "substantially," "about," and/or the like, in some embodiments refer to a range of 2% greater and 2% less, in some embodiments refer to a range of 5% greater and 5% less, in some embodiments refer to a range of 10% greater and 10% less, in some embodiments refer to a range of 15% greater and 15% less, and in some embodiments refer to a range of 20% greater and 20% less. For example, the substantially planar structure 110 or 310 discussed above may include a planar structure whose components, when laid out in a planar position (e.g., the position seen in FIG. 3), do not rise more than 2%, 5%, 10%, 15%, or 20% higher than other components of the substantially planar structure 110.

Use of the phrase "configured to," in one embodiment, refers to arranging, putting together, manufacturing, offering to sell, importing and/or designing an apparatus, hardware, logic, or element to perform a designated or determined task. In this example, an apparatus or element thereof that is not operating is still 'configured to' perform a designated task if it is designed, coupled, and/or interconnected to perform said designated task.

Furthermore, use of the phrases "to," "capable of/to," and or "operable to," in one embodiment, refers to some apparatus, hardware, and/or element designed in such a way to enable use of the apparatus, hardware, and/or element in a specified manner. Note that use of "to," "capable of/to," or "operable to," in one embodiment, refers to the latent state of an apparatus, hardware, and/or element, where the apparatus, hardware, and/or element is not operating but is designed in such a manner to enable use of an apparatus in a specified manner.

Reference throughout this specification to "one embodiment," "an embodiment," "certain embodiments," or "some embodiments" means that a particular feature, structure, or characteristic described in connection with the embodiment is included in at least one embodiment of the present disclosure. Thus, the appearances of the phrases "in one embodiment," "in an embodiment," "in certain embodiments," "in other embodiments," or "in some embodiments" in various places throughout this specification are not necessarily all referring to the same embodiment. Furthermore, the particular features, structures, or characteristics of any embodiments can be combined in any suitable manner with one or more other embodiments.

In the foregoing specification, a detailed description has been given with reference to specific example embodiments. It will, however, be evident that various modifications and changes can be made thereto without departing from the broader spirit and scope of the disclosure as set forth in the appended claims. The specification and drawings are, accordingly, to be regarded in an illustrative sense rather than a restrictive sense. Furthermore, the foregoing use of embodiment and other exemplarily language does not necessarily refer to the same embodiment or the same example, but can refer to different and distinct embodiments, as well as potentially the same embodiment, or any combinations thereof.

The words "example" and similar terms are used herein to mean serving as an example, instance or illustration. Any aspect or design described herein as "example" or the like is not necessarily to be construed as preferred or advantageous over other aspects or designs. Rather, use of the words "example" or the like is intended to present concepts in a concrete fashion. As used in this application, the term "or" is intended to mean an inclusive "or" rather than an exclusive "or." That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form. Moreover, use of the term "an embodiment" or "one embodiment" or "an implementation" or "one implementation" throughout is not intended to mean the same embodiment or implementation unless described as such. Also, the terms "first," "second," "third," "fourth," etc. as used herein are meant as labels to distinguish among different elements and can not necessarily have an ordinal meaning according to their numerical designation.

What is claimed is:

1. A multifunctional medical supply receptacle (MMSR), comprising:

an elongated, substantially planar structure comprising:

a first surface and a second surface, the first surface being opposite the second surface;

at least two substantially planar segments, the at least two substantially planar segments forming the substantially planar structure; and at least one hinged linker joining the at least two substantially planar segments, wherein the at least two substantially planar segments become a longitudinally rigid support structure responsive to a lateral bend across the at least one hinged linker, and wherein the substantially planar structure is selectively reconfigurable between a first closed configuration and a second configuration;

wherein in the first closed configuration, the substantially planar structure is arranged in a hollow, extruded, and prismatic or cylindrical shape to function as a storage apparatus; and wherein in the second configuration, the substantially planar structure is arranged in an alternate predetermined shape to function as at least one of a plurality of medical or emergency devices consisting of an orthopedic splint device, a pelvic binder device, a thoracic splint device, a cervical collar device, an extremity and junctional tourniquet device, an emergency pressure bandage, an immobilized patient transport device, or any combination thereof, and wherein the second configuration is achieved by an adjustment of the at least one hinged linker; and at least one receptacle pod forming an interior volume wherein supplies are stored, wherein the at least one receptacle pod comprises at least one closable opening, and wherein the at least one receptacle pod is configured to be attached to at least the first surface of the elongated, substantially planar structure.

2. The MMSR of claim 1, wherein the elongated, substantially planar structure comprises a semirigid material that is flexible at least longitudinally and laterally, wherein the semirigid material comprises at least one of a thermoset polymer, a thermoplastic polymer, a polycarbonate, or acrylic.

3. The MMSR of claim 1, wherein the first surface of the elongated, substantially planar structure is on an interior of the hollow, extruded, and prismatic or cylindrical shape, and the second surface of the elongated, substantially planar structure is on an exterior of the hollow, extruded, and prismatic or cylindrical shape.

4. The MMSR of claim 3, wherein the substantially planar structure selectably forms the hollow, extruded, and prismatic or cylindrical shape around the at least one receptacle pod, and wherein the at least one receptacle pod at least partially fills a space created within the hollow, extruded, and prismatic or cylindrical shape.

5. The MMSR of claim 3, wherein the hollow, extruded, and prismatic or cylindrical shape comprises a shape selected from a group consisting of: circular, ovular, oblong, polygonal, triangular, rectangular, square, quadrilateral, pentagonal, hexagonal, heptagonal, octagonal, and trapezoidal.

6. The MMSR of claim 1, wherein the at least one receptacle pod is removably attached via a hook and loop fastener to the first surface of the elongated, substantially planar structure.

7. The MMSR of claim 1, wherein the multifunctional medical supply receptacle further comprises a tightening component that selectably fastens the substantially planar structure peripherally closed.

8. The MMSR of claim 1, further comprising an emergency lighting system comprising:

one or more illumination devices removably coupled to at least one of a plurality of external edges of the elongated, substantially planar structure, the one or more illumination devices configured to provide illumination responsive to the MMSR being reconfigured from the first closed configuration to an open configuration.

9. The MMSR of claim 1, wherein the hinged linker comprises a seam sewn in a textile material disposed between the at least two substantially planar segments.

10. The MMSR of claim 1, wherein the elongated, substantially planar structure comprises a semirigid material, and wherein the hinged linker comprises at least one of:

a crease in the semirigid material; or a joint in the semirigid material.

11. A multifunctional medical supply receptacle (MMSR), comprising:

an elongated, substantially planar structure comprising:

a first surface and a second surface, the first surface being opposite the second surface;

at least one substantially planar segment, the at least one substantially planar segment forming the substantially planar structure;

a first closed configuration, wherein the substantially planar structure is arranged in a hollow, extruded, and prismatic or cylindrical shape to function as a storage apparatus; and a second configuration, wherein the substantially planar structure is arranged in an alternate predetermined shape to function as at least one of a plurality of medical or emergency devices consisting of an orthopedic splint device, a pelvic binder device, a thoracic splint device, a cervical collar device, an extremity and junctional tourniquet device, an emergency pressure bandage, an immobilized patient transport device, or any combination thereof, and wherein the second configuration is achieved by an adjustment of the at least one substantially planar segment; and at least one receptacle pod forming an interior volume wherein supplies are stored, wherein the at least one receptacle pod comprises at least one closable opening, and wherein the at least one receptacle pod is configured to be attached to at least the first surface of the elongated, substantially planar structure;

wherein the elongated, substantially planar structure comprises a semirigid material that is flexible at least longitudinally and laterally; and wherein the semirigid material becomes longitudinally rigid responsive to a lateral bend across at least a portion of the length of the planar structure.

12. The MMSR of claim 11, wherein the elongated, substantially planar structure further comprises at least one storage pocket attached to at least the first surface.

13. A method of using a multifunctional medical supply receptacle (MMSR), comprising:

providing the MMSR, the MMSR comprising:

an elongated, substantially planar structure comprising:

a first surface and a second surface, the first surface being opposite the second surface;

at least one substantially planar segment, the at least one substantially planar segment forming the substantially planar structure;

a first closed configuration, wherein the substantially planar structure is arranged in a hollow, extruded, and prismatic or cylindrical shape to function as a storage apparatus; and a second configuration, wherein the substantially planar structure is arranged in an alternate predetermined shape to function as at least one of a plurality of medical or emergency devices, and wherein the second configuration is achieved by an adjustment of the at least one substantially planar segment; and at least one receptacle pod forming an interior volume wherein supplies are stored, wherein the at least one receptacle pod comprises at least one closable opening, and wherein the at least one receptacle pod is configured to be attached to at least the first surface of the elongated, substantially planar structure; and converting the MMSR into at least one of the plurality of medical or emergency devices via the adjustment of the at least one substantially planar segment, wherein the at least one of the plurality of medical or emergency devices consists of an orthopedic splint device, a pelvic binder device, a thoracic splint device, a cervical collar device, an extremity and junctional tourniquet device, an emergency pressure bandage, an immobilized patient transport device, or any combination thereof;

wherein the elongated, substantially planar structure comprises a semirigid material that is flexible at least longitudinally and laterally; and wherein the semirigid material becomes longitudinally rigid responsive to a lateral bend across at least a portion of the length of the planar structure.

14. The method according to claim 13, wherein converting the MMSR into the at least one of the plurality of medical or emergency devices comprises:

situating the elongated, substantially planar structure of the MMSR to a patient in need of an orthopedic splint by aligning a longitudinal length of the MMSR parallel to a medial length of an injured body portion of the patient in need of an orthopedic splint;

applying a lateral-bend across at least a portion of a total length of the elongated, substantially planar structure of the MMSR; and wrapping a first retention component circumferentially around the elongated, substantially planar structure and the injured body portion.

15. The method according to claim 13, wherein converting the MMSR into the at least one of the plurality of medical or emergency devices comprises:

wrapping the elongated, substantially planar structure longitudinally or lengthwise and circumferentially around a perimeter of hips of a patient in need of a pelvic binder;

wrapping a tightening component peripherally around and parallel longitudinally to the elongated, substantially planar structure of the MMSR; and tightening the tightening component until a predetermined amount of pressure is achieved around the perimeter of the hips of a patient.

16. The method according to claim 13, wherein converting the MMSR into the at least one of the plurality of medical or emergency devices comprises:

wrapping the elongated, substantially planar structure longitudinally or lengthwise and circumferentially around an injured limb of a patient in need of a tourniquet, proximal to a hemorrhaging vein and/or artery; and compressing the hemorrhaging vein or artery by tightening a tightening component of the MMSR until a distal bleeding is controlled.

17. The method according to claim 13, wherein the elongated, substantially planar structure of the MMSR further comprises a notch, and wherein converting the MMSR into the at least one of the plurality of medical or emergency devices comprises:

securing the elongated, substantially planar structure longitudinally or lengthwise and circumferentially around a perimeter of a neck of a patient in need of an orthopedic cervical collar device; and positioning the notch beneath a jaw and chin of the patient.

18. The method according to claim 13, wherein converting the MMSR into the at least one of the plurality of medical or emergency devices comprises:

securing the elongated, substantially planar structure longitudinally or lengthwise and circumferentially around a perimeter of a thorax of a patient in need of a thoracic splint device; and tightening a tightening component until a predetermined amount of pressure is achieved around the perimeter of a thorax of a patient.

19. The method according to claim 13, wherein the MMSR further comprises an expandable separator device, and wherein converting the MMSR into the at least one of the plurality of medical or emergency devices comprises:

wrapping the elongated, substantially planar structure and/or a tightening component longitudinally or lengthwise and circumferentially around a perimeter of a bleeding junction of a patient in need of a junctional tourniquet device;

situating the expandable separator device over a hemorrhaging junctional artery and/or vein, proximal a hemorrhaging junctional injury site and therebetween the patient and the elongated, substantially planar structure and/or the tightening component;

tightening the elongated, substantially planar structure and/or the tightening component in place circumferentially around the perimeter of the bleeding junction; and expanding the expandable separator device.

20. The method according to claim 13, wherein the elongated, substantially planar structure further comprises a plurality of transport handles, and wherein converting the MMSR into the at least one of the plurality of medical or emergency devices comprises:

placing a patient in need of transport on the elongated, substantially planar structure; and transporting the patient using the plurality of transport handles.

* * * * *